US008757348B2

(12) United States Patent
Yoshikawa et al.

(10) Patent No.: US 8,757,348 B2
(45) Date of Patent: Jun. 24, 2014

(54) PAPER MONEY INPUT AND OUTPUT DEVICE

(75) Inventors: Eiichi Yoshikawa, Hasuda (JP); Keiji Sakai, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 1086 days.

(21) Appl. No.: 11/473,059

(22) Filed: Jun. 23, 2006

(65) Prior Publication Data

US 2007/0062782 A1 Mar. 22, 2007

(30) Foreign Application Priority Data

Jun. 27, 2005 (JP) ..... P2005-186653
Mar. 27, 2006 (JP) ..... P2006-084615

(51) Int. Cl.

| | |
|---|---|
| ***G07F 7/04*** | (2006.01) |
| ***G07D 7/00*** | (2006.01) |
| ***B65H 3/62*** | (2006.01) |
| ***B65H 1/02*** | (2006.01) |
| ***B21D 43/24*** | (2006.01) |
| ***B65H 3/56*** | (2006.01) |

(52) U.S. Cl.

CPC .. *G07D 7/00* (2013.01); *B65H 3/62* (2013.01); *B65H 1/025* (2013.01); *B21D 43/24* (2013.01); *B65H 3/56* (2013.01)

USPC ..... 194/206; 271/146; 271/165

(58) Field of Classification Search

CPC ... G07F 7/04; G07F 19/20; B65H 2701/1912; B65H 3/62; B65H 1/025; B65H 1/24; B65H 7/02; B65H 31/40; B65H 1/06; B65H 3/063; B65H 3/56; B65H 31/38; B65H 2511/20; B65H 2701/1932; G07D 11/0081; G07D 11/0084; G07D 7/00; G07D 7/12; G07D 7/20; G07D 11/0018; B65C 9/10; B21D 43/24; B41J 3/601

USPC ..... 194/206, 207; 271/146, 210, 165; 209/534; 382/135

See application file for complete search history.

(56) References Cited

U.S. PATENT DOCUMENTS 4,883,183 A 11/1989 Kimura et al.
5,790,697 A * 8/1998 Munro et al. ..... 382/135

(Continued)

FOREIGN PATENT DOCUMENTS

EP 0 540 867 A 5/1993
EP 1 184 817 A 3/2002

(Continued)

OTHER PUBLICATIONS

Notice of Allowance issued in corresponding Taiwanese Patent Application No. 095122662, issued Jun. 6, 2008, 5 pages including English Translation.

(Continued)

*Primary Examiner* — Jeffrey Shapiro
(74) *Attorney, Agent, or Firm* — Nixon & Vanderhye P.C.

(57) ABSTRACT

A paper money input and output device includes a money input unit to which paper money is paid in, a money output unit which releases paper money to the exterior of the device, a plurality of recirculation cases which, along with storing paper money, also output stored paper money to the money output unit, a collection case which can store paper money from the money input unit or the plurality of recirculation cases, and a rejected-for-payout case which stores money which has been paid out from the recirculation cases and which has been rejected for outpayment; and, along with these units being arranged so that the thickness direction of the paper money which they receive is in the same direction, and along with them being provided in a stacked state in that direction, on one side only of a direction which is orthogonal with respect to the direction along which the money input unit, the money output unit, the collection case, the rejected-for-payout case, and the recirculation cases are provided in a stacked state, and a conveyance unit is provided which connects them together.

13 Claims, 10 Drawing Sheets

(56) References Cited

U.S. PATENT DOCUMENTS

| | | | | |
|---|---|---|---|---|
| 5,927,936 | A * | 7/1999 | Arikawa et al. | 414/788 |
| 6,315,279 | B1 * | 11/2001 | Minamishin et al. | 271/3.15 |
| 2001/0035329 | A1 * | 11/2001 | Toda et al. | 194/206 |
| 2002/0025065 | A1 | 2/2002 | Yamamoto | |
| 2002/0036159 | A1 * | 3/2002 | Graef et al. | 209/534 |
| 2002/0043443 | A1 | 4/2002 | Mizuta et al. | |
| 2002/0060400 | A1 | 5/2002 | Kobayashi et al. | |
| 2002/0088850 | A1 * | 7/2002 | Katou et al. | 235/379 |
| 2004/0182677 | A1 * | 9/2004 | Katou et al. | 194/206 |
| 2004/0245333 | A1 * | 12/2004 | Kraft et al. | 235/381 |
| 2009/0211874 | A1 * | 8/2009 | Oie et al. | 194/206 |

FOREIGN PATENT DOCUMENTS

| | | |
|---|---|---|
| GB | 2 345 571 A | 7/2000 |
| JP | A-52-116294 | 9/1977 |
| JP | 63-095595 | 4/1988 |
| JP | 02-305758 | 12/1990 |
| JP | 06-072590 | 3/1994 |
| JP | 09-091492 | 4/1997 |
| JP | A-2000-099790 | 4/2000 |
| JP | A-2001-134839 | 5/2001 |
| JP | A-2001-331845 | 11/2001 |
| JP | 2003-288630 | 10/2003 |
| TW | 497088 | 8/2002 |
| TW | 514838 | 12/2002 |

OTHER PUBLICATIONS

Japanese Notice of Reasons for Rejection and English Translation for corresponding Japanese Application No. 2006-084615, mailed Jun. 21, 2011, 4 pages.

Japanese Office Action and English Translation for corresponding Japanese Appln. No. 2005-186653, mailed Oct. 26, 2010, 4 pages.

* cited by examiner

PAPER MONEY INPUT AND OUTPUT DEVICE

BACKGROUND OF THE INVENTION

1. Field of the Invention

The present invention relates to a paper money input and output device which is capable of utilizing banknotes which have been inputted as banknotes for being outputted, and particularly relates to making such a device more compact.

Priority is claimed on Japanese Patent Application No. 2005-186653, filed Jun. 27, 2005 and Japanese Patent Application No. 2006-84615, filed Mar. 27, 2006, the contents of which are incorporated herein by reference 2. Description of Related Art A conventional paper money input and output device, capable of utilizing banknotes which have been inputted as money for being outputted, is described in Japanese Unexamined Patent Application, First Publication, No. 2003-288630. In this paper money input and output device, during in-payment, paper money is paid in in a standing state, with its short side direction vertical, and moreover with its long side direction coinciding with the depth direction of the device. While still in a standing state, the paper money is drawn out along the direction of its long side, thus conveyed and identified, and then stored in a recirculation case or in a collection case, still in a state in which its long side direction coincides with the depth direction of the device. Furthermore, paper money is paid out to a money output unit from the recirculation cases, or is eliminated to a reject case or to a collection case, in a state with its long side direction coinciding with the depth direction of the device.

With this paper money input and output device, along with providing the money input unit, the money output unit, the reject case, and the collection case in a stacked state in the widthwise direction on the front surface side of the device body, a plurality of recirculation cases are provided in a stacked state on the rear surface side of the device body; and a cylindrical tubular drum type conveyance unit, which performs input and output of paper money between the various sections of the device, is provided at an intermediate portion in the fore and aft direction of the device body. Due to this, it is possible to restrict the height and the width of the device, so that it is possible to make it more compact; for example, it can be applied as a paper money input and output device in the vicinity of a POS register.

However, the above-described paper money input and output device uses a drum type conveyance unit, the diameter of which is a value determined by the maximum length of the paper money. Furthermore, since a certain space is required around the periphery of the drum type conveyance unit for locating a plurality of separation members, and for arranging the branched conveyance paths, there has, in particular, been the problem that it has not been possible sufficiently to enhance the compactness of the device body in its depth direction, which is the direction which links the money input unit, the money output unit, the reject case and the collection case, the drum type conveyance unit, and the plurality of recirculation cases. It should be understood that, in the case of the above described paper money input and output device, a replenishment case for replenishing the paper money in the device may also serve as a collection case, or may be provided as a combined recovery and replenishment case.

Furthermore, since the branching conveyance units around the periphery of the drum type conveyance unit extend outwards and diverge at various different angular directions, this can also become a cause for the occurrence of jamming during conveyance of the paper money.

SUMMARY OF THE INVENTION

Accordingly, an object of the present invention is to provide a paper money input and output device which can be made more compact overall, and moreover which can suppress the occurrence of jamming during the conveyance of paper money.

In order to achieve the above described objective, the paper money input and output device of the present invention comprises: a money input unit to which paper money is paid in from the exterior of the device; a money output unit which releases paper money from the interior of the device, so that it becomes possible for it to be taken out to the exterior of the device; a plurality of recirculation cases which, along with storing paper money, output stored paper money to the money output unit; a collection case which can store paper money from the money input unit or the plurality of recirculation cases; and a rejected-for-payout case which stores money, among the paper money which has been paid out from the recirculation cases, which has been rejected for outpayment; wherein the money input unit, the money output unit, the collection case, the rejected-for-payout case, and the plurality of recirculation cases are provided in a stacked state in the thickness direction of the paper money which they receive, so that the thickness direction of the paper money is in the same direction; and a conveyance unit is arranged so as to connect the money input unit, the money output unit, the collection case, the rejected-for-payout case, and the plurality of recirculation cases on one side only of a direction which is orthogonal with respect to the direction along which the money input unit, the money output unit, the collection case, the rejected-for-payout case, and the plurality of recirculation cases are provided in a stacked state.

Since, according to the present invention as defined above, the thickness directions of the paper money which has been put into each of the money input unit, the money output unit, the plurality of recirculation cases, the collection case, the replenishment case, and the rejected-for-payout case are all set to be in the same direction, and these units are provided in a stacked state in that direction, and moreover the conveyance unit which connects these units together is arranged on only one side of a direction which is orthogonal with respect to the direction along which those units are provided as stacked, accordingly it is possible to make the device as a whole more compact, because it does not all lie along one direction. Moreover, since the conveyance unit is arranged on only one and the same side with respect to the money input unit, the money output unit, the collection case, the replenishment case, the rejected-for-payout case, and the plurality of recirculation cases, accordingly, while the direction for distribution of paper money to each of these sections does not become complicated, and while it is possible to suppress the occurrence of jamming during the conveyance of the paper money, also, even if by an unlikely chance a jam should occur, it is possible to eliminate that jam in a simple and easy manner, since access to the conveyance unit is simple.

With the paper money input and output device of the present invention, along with the money input unit, the money output unit, and the collection case together constituting a first structural group and the rejected-for-payout case and the plurality of recirculation cases constituting a second structural group, in the conveyance unit, an inpayment identification unit which identifies paper money which has been paid in may be provided on the side of the first structural group in an intermediate conveyance path between the first structural group and the second structural group, and an outpayment identification unit which identifies paper money for outpayment may be provided on the side of the second structural group in the intermediate conveyance path.

According to this structure, even though the intermediate conveyance path is made to be short, along with ensuring an adequate distance between the inpayment identification unit and the recirculation case, which is required to be at least as long as the length of one bill of the paper money, it is also possible to ensure an adequate distance between the outpayment identification unit and the money output unit, which is similarly required to be at least as long as the length of one bill of the paper money. Accordingly, it is possible to shorten the length of the combination of the money input unit, the money output unit, the collection case, the rejected-for-payout case, and the plurality of recirculation cases in their direction of stacking by yet a further factor.

Furthermore, provided that the paper money which has been paid into the money input unit and conveyed by the conveyance unit has been identified by the inpayment identification unit as paper money which can be paid in, it comes to be stored in the corresponding recirculation case, while, if it is identified by the inpayment identification unit as paper money which cannot be paid in and which must therefore be rejected for inpayment, it can be conveyed to the money output unit or to the collection case by reversing the conveyance unit. Furthermore if, for example, the paper money which has been stored in the recirculation case and conveyed by the conveyance unit is identified by the outpayment identification unit as paper money which can be paid out, it comes to be conveyed to the money output unit, while, if it is identified by the outpayment identification unit as paper money which cannot be paid out and which must therefore be rejected for outpayment, it can be stored in the rejected-for-payout case by reversing the conveyance unit. Due to this, it is possible to suppress an increase of the processing time as much as possible, by only reversing the conveyance unit upon identification of paper money which is rejected for inpayment or rejected for outpayment, the frequency of occurrence of which is low.

With the paper money input and output device of the present invention, based upon the timing at which paper money which is being conveyed by the conveyance unit from the money input unit is detected by the inpayment identification unit, a control unit which controls the conveyance unit may temporarily stop the conveyance of the paper money by the conveyance unit, and may restart the conveyance of the paper money by the conveyance unit, when a state in which it is possible for the paper money to be received into the recirculation case is established.

According to this structure, it is not necessary for the paper money to be conveyed during the time period from when its detection is completed until when its identification is completed, so that it is possible to make the distance between the inpayment identification unit and the recirculation case yet shorter. Accordingly, it is possible to shorten the length of the combination of the money input unit, the money output unit, the collection case, the rejected-for-payout case, and the plurality of recirculation cases in their direction of stacking by yet a further factor.

With the paper money input and output device of the present invention, based upon the timing at which paper money which is being conveyed by the conveyance unit from the recirculation case is detected by the outpayment identification unit, a control unit which controls the conveyance unit may temporarily stop the conveyance of the paper money by the conveyance unit, and may restart the conveyance of the paper money by the conveyance unit, when a state in which it is possible for the paper money to be received into the money output unit is established.

According to this structure, it is not necessary for the paper money to be conveyed during the time period from when its detection is completed until when its identification is completed, so that it is possible to make the distance between the outpayment identification unit and the money output unit yet shorter. Accordingly, it is possible to shorten the length of the combination of the money input unit, the money output unit, the collection case, the rejected-for-payout case, and the plurality of recirculation cases in their direction of stacking by yet a further factor.

With the paper money input and output device of the present invention, in the first structural group, the money input unit, the money output unit, and the collection case may be stacked in that order, and moreover the collection case may be provided on the side closest towards the second structural group.

According to this structure, it is possible to ensure a sufficient distance between the outpayment identification unit and the money output unit, while still maintaining the convenience of use of the money input unit and the money output unit.

With the paper money input and output device of the present invention, in the second structural group, the rejected-for-payout case may be provided on the side closest towards the first structural group.

According to this structure, it is possible to ensure sufficient distance between the inpayment identification unit and the recirculation case.

The paper money input and output device of the present invention may further comprises a replenishment case for replenishing the paper money in the plurality of recirculation cases, the replacement case being provided as stacked with the money input unit, the money output unit, the collection case, the rejected-for-payout case, and the plurality of recirculation cases, and connected to the money input unit, the money output unit, the collection case, the rejected-for-payout case, and the plurality of recirculation cases by the conveyance unit.

With the paper money input and output device of the present invention, the collection case and the replenishment case may be constituted by a common replenishment and collection case.

According to this structure, along with it being possible to anticipate a reduction in cost due to the reduction in the number of component parts, it is also possible to make the paper money input and output device even more compact overall.

With the paper money input and output device of the present invention, the money output unit may include a front side money output unit on the side of an operator, and a rear side money output unit on the side of a customer.

According to this structure, along with it being possible to make the device as a whole be more compact, and suppress the occurrence of jamming, it is also possible to enhance the convenience, by making it possible to take out money both on the side of the operator and also on the side of the customer.

DETAILED DESCRIPTION OF THE INVENTION

A first embodiment of the paper money input and output device according to the present invention will be explained in the following with reference to the drawings.

Figure 1:
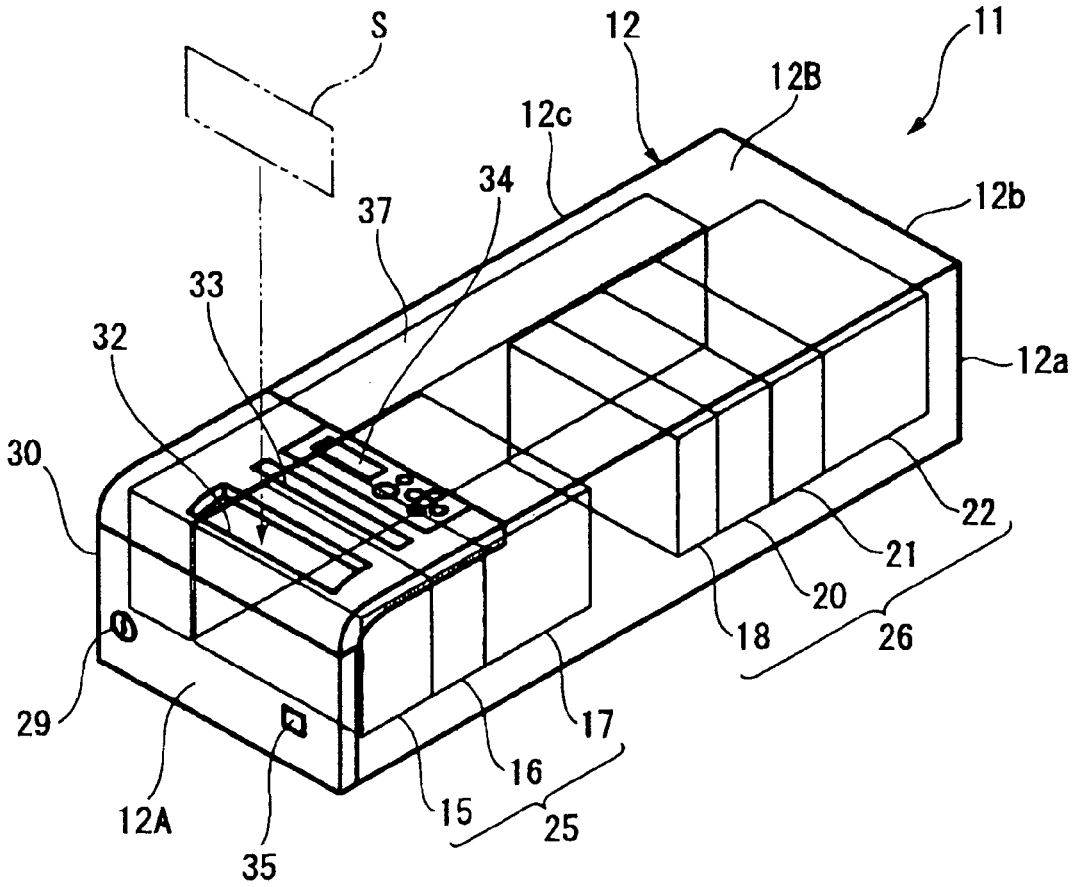
FIG. 1 is a transparent perspective view, schematically showing a paper money input and output device which is a first embodiment of the present invention.

A paper money input and output device 11 of the first embodiment is one which performs inpayment of sales takings and outpayment of change by, for example, being placed along with a coin input and output device, not shown in the figure, in the vicinity of a POS register; and, as shown in FIG. 1, it comprises a chassis 12 which is shaped approximately as a rectangular parallelepiped. This chassis 12 is set up and used with its shortest edge portion 12*a* being oriented in the height direction, its next shortest edge portion 12*b* of intermediate length being oriented in the widthwise direction (the left and right direction), and its longest edge portion 12*c* being oriented in the depth direction. Due to this, the chassis 12 faces the operator with its front surface 12A (one of its sides), which is the one most towards the operator, being oriented in letterbox format and being surrounded by its shortest edge portions 12*a* and its intermediate length edge portions 12*b*, and furthermore with its upper surface 12B being surrounded by these intermediate length edge portions 12*b* and by its longest edge portions 12*c*. It should be understood that the expressions "height direction", "widthwise direction", and "depth direction" which are used in the following explanation, if not particularly limited, denote the height direction, the widthwise direction, and the depth direction of the chassis 12.

Figure 2:
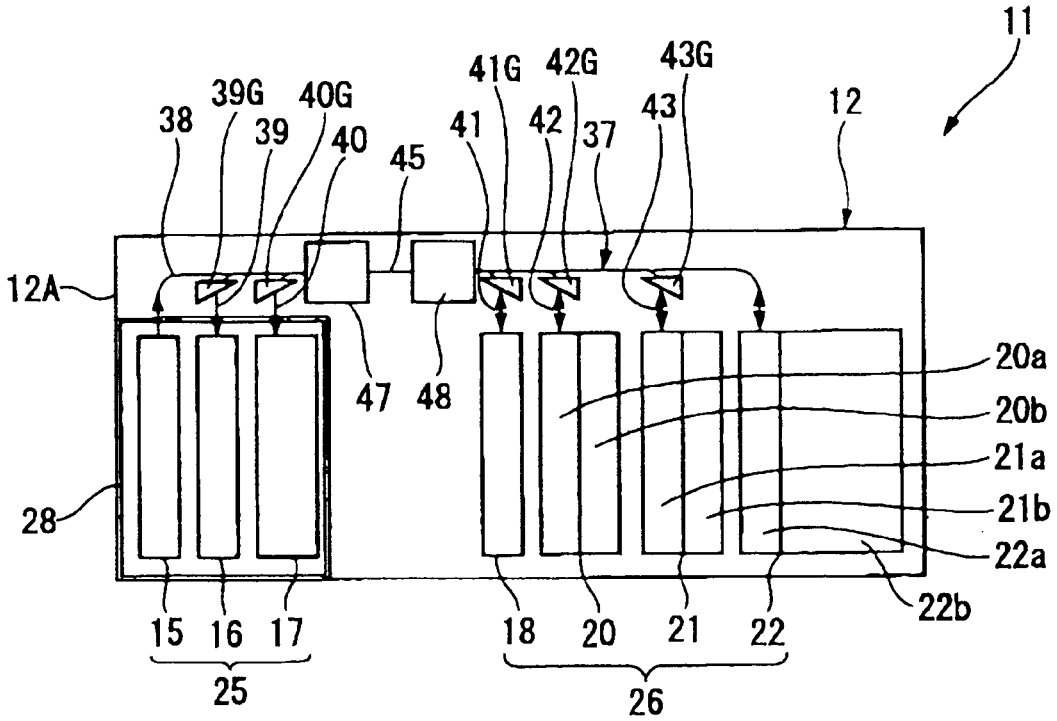
FIG. 2 is a sectional plan view, schematically showing this paper money input and output device according to the first embodiment of the present invention.

As shown in FIG. 2, in this chassis 12, there are arranged, in order along its depth direction from the side of its front surface 12A: a money input unit 15 of which the top can be opened in order for paper money S (also referred to as paper money bill/bills S hereinafter) to be paid in from the exterior of the device; a money output unit 16 of which the top can be opened in order for paper money S to be released, so as to allow it to be removed to the exterior of the device; a removable type collection case 17 which can store paper money S from the money input unit 15 and paper money S from a plurality of recirculation cases 20 through 22 which will be described hereinafter; a non-detachable rejected-for-payout case 18 which stores paper money which has been rejected for pay-out; and a plurality, in concrete terms three, non-detachable recirculation cases which, along with storing paper money S, pay out stored paper money S to the money output unit 16: a recirculation case 20; a recirculation case 21; and a recirculation case 22.

In this structure, at the front surface 12A, the money input unit 15, the money output unit 16, and the collection case 17 together constitute a first structural group 25, while, at the opposite end to the front surface 12A, the rejected-for-payout case 18, the recirculation case 20, the recirculation case 21, and the recirculation case 22 together constitute a second structural group 26. Due to this, in the first structural group 25, the money input unit 15, the money output unit 16, and the collection case 17 are arranged in that order, and moreover the collection case 17 comes to be the unit which is provided most towards the second structural group 26; while, in the second structural group 26, the rejected-for-payout case 18 comes to be the unit which is provided most towards the first structural group 25.

Figure 3:
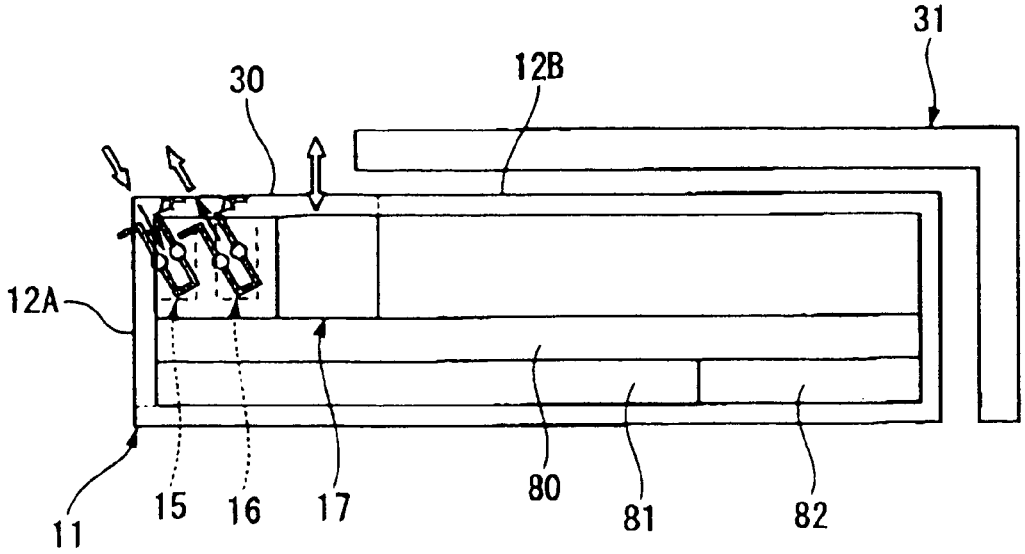
FIG. 3 is a side sectional view, schematically showing this paper money input and output device according to the first embodiment of the present invention.

It should be understood that the money input unit 15, the money output unit 16, and the collection case 17 of the first structural group 25 are made as a single unit 28 which can be detached from the chassis 12. Thus, as shown in FIG. 1, a portion of the chassis 12 from its portion which constitutes the front surface 12A to its portion towards the upper surface 12B which covers the money input unit 15 and the money output unit 16 is made as a lid portion 30 which can be opened and closed by a lock 29 being actuated with a separate key; and, by opening and closing this lid portion 30, the unit 28 can be fitted to and removed from the chassis 12. Furthermore, the collection case 17 can be fitted to and detached from the unit 28, and is fitted to and removed from the unit 28 by the lid portion 30 being opened. It should be understood that, in this lid portion 30, in its portion which is included in the upper surface 12B, in order from the side of the front surface 12A, there are provided: an inpayment aperture 32 for paying in paper money S to the money input unit 15; an outpayment aperture 33 for extruding paper money S from the money output unit 16 so that it can be taken out; and an operation and display section 34 which, along with a receiving operational input, also provides a display to the operator. It should be understood that a register stand 31 shown in FIG. 3 is provided so as to cover over the rear portion of the paper money input and output device 11, and also so as to allow a portion thereof towards its front surface 12A to project, in order to make it possible to open and close the lid portion 30. Furthermore, for maintenance and the like, it is ensured that, in the state with the lid portion 30 opened, all of the mechanism sections within the chassis 12 can be pulled forwards. In addition to the above described lock 29, a power supply switch 35 is provided in a portion of the lid portion 30 which is included in the front surface 12A.

Each of the above-described money input unit 15, money output unit 16, collection case 17, rejected-for-payout case 18, recirculation case 20, recirculation case 21, and recirculation case 22 has a shape which is of letterbox format in the widthwise direction, just like the front surface 12A, and, along with all of them positionally mutually matching one another in the widthwise direction and the height direction, it is arranged for them to receive paper money S which is inserted in a standing state with its short side direction extending along the height direction and with its long side direction extending along the widthwise direction. In other words, the money input unit 15, the money output unit 16, the collection case 17, the rejected-for-payout case 18, and the recirculation cases 20 through 22 are provided in a stacked state (i.e. matched along the depth direction), and so that the thickness directions of the paper money S put into them all lie along that same direction.

The above-described money input unit 15, money output unit 16, collection case 17, rejected-for-payout case 18, and recirculation cases 20 through 22 are provided up against one side in the widthwise direction within the chassis 12, and, in a space which is thereby defined at the other side in the widthwise direction of the chassis 12, there is provided a conveyance unit 37 which connects together the money input unit 15, the money output unit 16, the collection case 17, the rejected-for-payout case 18, and the recirculation cases 20 through 22, and performs exchange of paper money S between them. In other words, this conveyance unit 37 is disposed on only one side in the widthwise direction, which is a direction which is orthogonal to the depth direction, which is the direction along which the money input unit 15, the money output unit 16, the collection case 17, the rejected-for-payout case 18, the recirculation case 20, the recirculation case 21, and the recirculation case 22 are stacked. It should be understood that this conveyance unit 37 is one which rotates forward and backward under the control of a control unit 81 shown in FIG. 3, and it conveys the paper money S in a standing state, with its long side direction always extending along the direction of conveyance and its short side direction extending in the vertical direction. And a drive system shown in FIG. 3 is located under the money input unit 15, the money output unit 16, the collection case 17, the rejected-for-payout case 18, the recirculation cases 20 through 22, and the conveyance unit 37 for driving them, with the control unit 81 and a power supply 82 being located under that.

The conveyance unit 37, as shown in FIG. 2, comprises: a main conveyance path 38 which connects between the money unit 15 which is the closest one to the front surface 12A, and the recirculation case 22 which is at the opposite end of the stack; a branched off conveyance path 39 which branches off from the main conveyance path 38 in the neighborhood of the money output unit 16 and is connected to the money output unit 16; a branched off conveyance path 40 which branches off from the main conveyance path 38 in the neighborhood of the collection case 17 and is connected to the collection case 17; a branched off conveyance path 41 which branches off from the main conveyance path 38 in the neighborhood of the-rejected-for-payout case 18 and is connected to the rejected-for-payout case 18; a branched off conveyance path 42 which branches off from the main conveyance path 38 in the neighborhood of the recirculation case 20 and is connected to the recirculation case 20; and a branched off conveyance path 43 which branches off from the main conveyance path 38 in the neighborhood of the recirculation case 21 and is connected to the recirculation case 21.

Furthermore, the conveyance unit 37 comprises: a separation unit 39G which, on the one hand, in the opened state, conveys paper money S transported via the main conveyance path 38 which has arrived from the side of the second structural group 26 to the money output unit 16, by guiding it into the branched off conveyance path 39 which is connected to the money output unit 16, and which on the other hand, in the closed state, conveys the paper money S just as it is via the main conveyance path 38; and another separation unit 40G which, on the one hand, in the opened state, conveys paper money S transported via the main conveyance path 38 which has arrived from the side of the second structural group 26 to the collection case 17, by guiding it into the branched off conveyance path 40 which is connected to the collection case 17, and which on the other hand, in the closed state, conveys the paper money S just as it is via the main conveyance path 38.

Moreover, the conveyance unit 37 comprises: a separation unit 41G which, on the one hand, in the opened state, conveys paper money S transported via the main conveyance path 38 which has arrived from the side of the first structural group 25 to the rejected-for-payout case 18, by guiding it into the branched off conveyance path 41 which is connected to the rejected-for-payout case 18, and which on the other hand, in the closed state, conveys the paper money S just as it is via the main conveyance path 38; a separation unit 42G which, on the one hand, in the opened state, conveys paper money S transported via the main conveyance path 38 which has arrived from the side of the first structural group 25 to the recirculation case 20, by guiding it into the branched off conveyance path 42 which is connected to the recirculation case 20, and which on the other hand, in the closed state, conveys the paper money S just as it is via the main conveyance path 38; and a separation unit 43G which, on the one hand, in the opened state, conveys paper money S transported via the main conveyance path 38 which has arrived from the side of the first structural group 25 to the recirculation case 21, by guiding it into the branched off conveyance path 43 which is connected to the recirculation case 21, and which on the other hand, in the closed state, conveys the paper money S just as it is via the main conveyance path 38. It should be understood that the above-described separation units 39G through 43G are normally in the closed state, and, when required, are put into the opened state by being driven by the control unit 81.

Here, the recirculation case 20 comprises an intermediate pool portion 20*a*, on the side of the front surface 12A, which temporarily accumulates paper money S which has been received and inputted from the branched conveyance path 42, and a storage section 20*b*, at the opposite side from the front surface 12A, which stores paper money S from the intermediate pool portion 20*a*; and it is capable of outputting paper money S which is stored in the storage section 20*b* to the branched off conveyance path 42. In the same manner, the recirculation case 21 comprises an intermediate pool portion 21*a*, on the side of the front surface 12A, which temporarily accumulates paper money S which has been received and inputted from the branched conveyance path 43, and a storage section 21*b*, at the opposite side from the front surface 12A, which stores paper money S from the intermediate pool portion 21*a*; and it is capable of outputting paper money S which is stored in the storage section 21*b* to the branched off conveyance path 43. Also similarly, the recirculation case 22 comprises an intermediate pool portion 22*a*, on the side of the front surface 12A, which temporarily accumulates paper money which has been received and inputted from the main conveyance path 38, and a storage section 22*b*, at the opposite side from the front surface 12A, which stores paper money S from the intermediate pool portion 22*a*; and it is capable of outputting paper money S which is stored in the storage section 22*b* to the main conveyance path 38. It should be understood that the amount of storage provided by the storage section 22*b* of the recirculation case 22, which is the one furthest away from the first structural group 25, is larger than the amounts provided by the storage sections 20*b*, 21*b* of the other recirculation cases 20, 21, so that it is arranged for this storage section 22*b* to store the type of paper money S of which it is required to handle the greatest amount, i.e. 1,000 yen notes. Furthermore, it is arranged for the recirculation case 20, which is the one closest to the first oral group 25, to store some other type of paper money S, for example 10,000 yen notes; while it is arranged for the intermediate recirculation case 21 to store yet another type of paper money, for example 5,000 yen notes.

An inpayment identification unit 47, which identifies paid in paper money S during its conveyance from the side of the first structural group 25 toward the side of the second structural group 26, is provided in the main conveyance path 38 between the first structural group 25 and the second structural group 26: in more concrete terms, in the intermediate conveyance path 45, on the side thereof of the first structural group 25, between the position where the branched off conveyance path 40 branches off therefrom and the position where the branched off conveyance path 41 branches off therefrom; and, on the side of the second structural group 26 of this intermediate conveyance path 45, there is provided an outpayment identification unit 48, which identifies overlapped forwarding and so on of paper money S for outpayment, during its conveyance from the side of the second structural group 26 to the side of the first structural group 25.

It should be understood that, so as to make it possible to stop the conveyance of the paper money S which has been identified by the inpayment identification unit 47 before it arrives at the nearest recirculation case 20, i.e., in more concrete terms, at the branching off position of the branched off conveyance path 42, the distance from the position at which identification information detection by the inpayment identification unit 47 is completed to the recirculation case 20 which is the closest one to the side of the front surface 12A, i.e. in more concrete terms, to the branching off position of the branched off conveyance path 42, is set to be a distance equal to "the maximum length of the long side of the paper money S"+"the conveyance distance during the amount of time required for the conveyance unit 37 to stop upon application of braking by the conveyance unit 37"; and, in order to make it possible to stop the conveyance of the paper money S which has been identified by the outpayment identification unit 48 before it arrives at the money output unit 16, i.e., in more concrete terms, at the branching off position of the branched off conveyance path 39, the distance from the position at which identification information detection by the outpayment identification unit 48 is completed to the money output unit 16, i.e., in more concrete terms, to the branching off position of the branched off conveyance path 39, is also set to be a distance equal to "the maximum length of the long side of the paper money S"+"the conveyance distance during the amount of time required for the conveyance unit 37 to stop upon application of braking by the conveyance unit 37". The positions of the inpayment identification unit 47 and the outpayment identification unit 48 in the intermediate conveyance unit 37 arc set so as to ensure these distances, and the gap between the first structural group 25 and the second structural group 26 is set based thereupon.

Figure 4B:
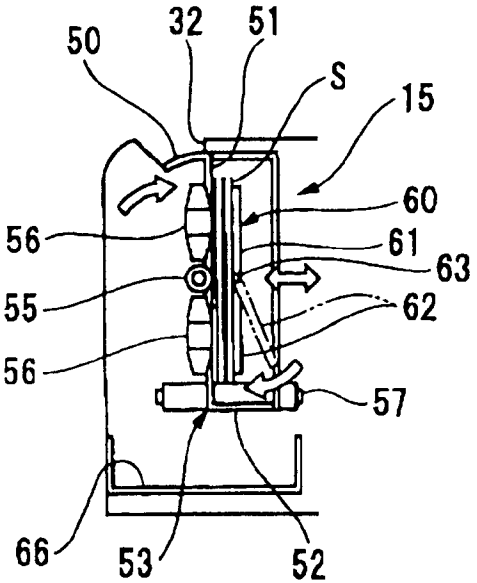
FIGS. 4A, 4B, and 4C are respectively an elevation view, a side view, and a plan view, schematically showing a money input unit of this paper money input and output device according to the first embodiment of the present invention.
Figure 4C:
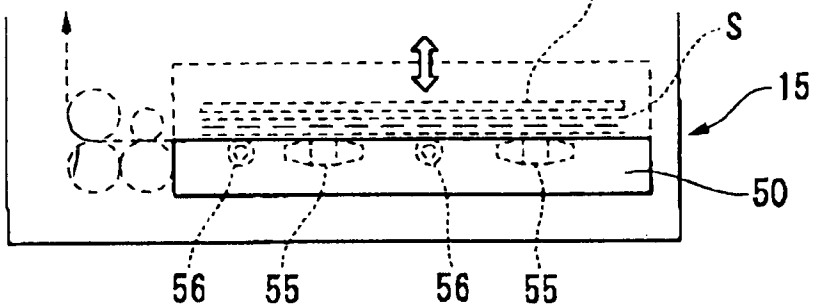
Figure 4A:
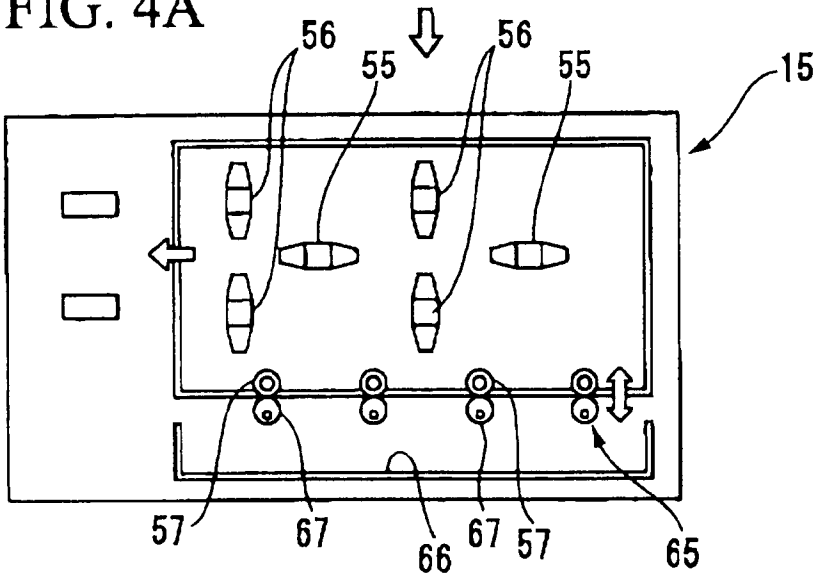

The money input unit 15, as shown in FIGS. 4A through 4C, comprises: a reception stand 53 which, along with being provided so as to be rotatable about a rotational axis in the widthwise direction, comprises: an upper shutter 50, a wall plate portion 51, and a lower bottom plate portion 52; shift rollers 55 of which both sides along their axial lines are of tapered form, rotatably provided in the wall plate portion 51 with their central axial lines oriented along the widthwise direction; forwarding rollers 56 of which both sides along their axial lines are of tapered form, rotatably provided in the wall plate portion 51 with their central axial lines oriented along the vertical direction; and a plurality of cylindrical pillar shaped guide rollers 57 which are provided above the bottom plate portion 52 so as to rotate freely, with their central axial lines oriented along the depth direction.

Furthermore, this money input unit 15 comprises a bill press 60 which is provided at the deep side of the wall plate portion 51 in the depth direction, and this bill press 60 comprises an upper plate portion 61 which is always oriented orthogonally with respect to the depth direction, and a lower plate portion 62 whose upper edge portion is rotatably supported on the lower edge portion of this upper plate portion 61, around a shaft 63 extending along the widthwise direction as a center.

Furthermore, a shaking mechanism 65 which vibrates the reception stand 53 vertically and thereby causes any foreign bodies to fall out from the paper money S is provided at the money input unit 15, and a foreign body reception tray 66 is provided under the guide rollers 57, which receives any foreign bodies which fall out from the paper money S. Here, the shaking mechanism 65 comprises a plurality of eccentric rollers 67 which are contacted against the reception stand 53 from underneath, and the reception stand 53 is caused to vibrate in the vertical direction by these eccentric rollers 67 being rotated.

Figure 5:
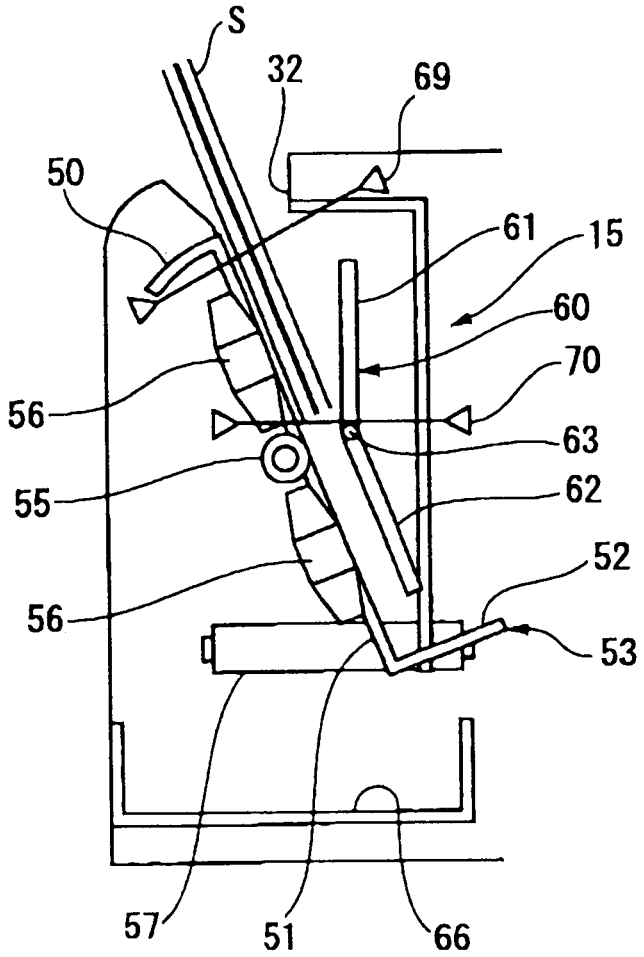
FIG. 5 is a side view schematically showing the money input unit of this paper money input and output device according to the first embodiment of the present invention, and shows a situation in which a reception stand is tilted.

In addition, as shown in FIG. 5, the money input unit 15 is provided, in its upper portion, with a sensor 69 for detecting the timing of drive stopping of the shift rollers 55, and, in its intermediate portion, with a sensor 70 for detecting the timing of drive starting of the shift rollers 55.

The above-described inpayment aperture 32 is provided at a position at which, when the reception stand 53 at the upper portion of the money input unit 15 has been tilted, it is opened by the shutter 50 of the reception stand 53, so that it becomes possible to pay in paper money S. In other words, upon paper money S being paid in to the money input unit 15 in the state in which the reception stand 53 has been tilted, this paper money S is pulled in by the shift rollers 55 to a position in which it contacts against the guide rollers 57, and, as shown in FIG. 4B, after the wall plate portion 51 of the reception stand 53 has returned to an attitude along the vertical so that the inpayment aperture 32 has been closed by the shutter 50, the paper money S is shaken by the shaking mechanism 65, and thereafter, while the lower plate portion 62 of the bill press 60 is rotated so as to be kept in contact against the paper money S, the paper money S is forwarded by the forwarding rollers 56 out to the main conveyance path 38.

It should be understood that the money output unit 16 also has the same structure as the money input unit 15: paper money S which has been fed in from the branched off conveyance path 39 is further pulled in by the forwarding rollers, and the reception stand is tilted, and the paper money S is projected from the outpayment aperture 33 by the shift rollers, so that it becomes possible to take it out.

Each of the processes in the operation of the paper money input and output device 11 according to this first embodiment, having the structure described above, will now be separately explained.

[Inpayment Processing]

During inpayment processing, the control unit 81 rotates the reception stand 53 of the money input unit 15, and, in this state, paper money S may be paid in from the inpayment aperture 32 in a standing state, with its short side direction extending along the height direction, and with its long side direction extending along the widthwise direction. When the fact that paper money S has been paid in to the inpayment aperture 32 has been detected by the sensor 70, the control unit 81 pulls in the paper money S with the shift rollers 55; and, when the fact that the paper money S has been pulled in to a position in which it contacts against the guide rollers 57 has been detected by the sensor 69, the shift rollers 55 are stopped; and, after the reception stand 53 has been returned so that the wall plate portion 51 becomes vertical, the money S is shaken with the shaking mechanism 65; and, thereafter, the lower plate portion 62 of the bill press 60 is rotated, and the paper money S is forwarded out into the main conveyance path 38 one bill at a time, separately, by the forwarding rollers 56 which are contacted against the paper money S.

The paper money bill S which has thus been forwarded out into the main conveyance path 38 is identified, during its conveyance, by the inpayment identification unit 47, but the control unit 81 temporarily stops the conveyance of that paper money bill S by the conveyance unit 37, at the timing when it arrives at the abovementioned position at which its identification information detection has been completed, in concrete terms, at the timing when the detection of that paper money bill S over its entire long side direction by the various sensors for identifying the paper money bill S which are included in the inpayment identification unit 47 has been completed. And when, during this stoppage of conveyance, the paper money bill S has been identified by the inpayment identification unit 47 as being proper for inpayment, next, by the control unit 81 performing, according to requirements, an opening operation of that one, among the separation units 42G, 43G for the recirculation cases 20 through 22, for diversion of the corresponding money type, when a state has been established in which that paper money bill S can be taken into the corresponding one among the recirculation cases 20 through 22 for the different types of money, then the conveyance of that paper money bill S by the conveyance unit 37 is restarted. By doing this, that paper money bill S is stored in the one among the recirculation cases 20 through 22 for the various types of money, which corresponds to that type of money. Thus, if the type of this bill is a 1,000 yen note which can be paid in, then this is accumulated in the intermediate pool portion 22*a* of the recirculation case 22 on the main conveyance path 38 just as it is; while, if the type of this bill is a 10,000 yen note which can be paid in, then this is accumulated in the intermediate pool portion 20*a* of the recirculation case 20 via the conveyance path 42 which is branched off at the separation unit 42G; and, if the type of this bill is a 5,000 yen note which can be paid in, then this is accumulated in the intermediate pool portion 21*a* of the recirculation case 21 via the conveyance path 43 which is branched off at the separation unit 43G.

Thus, in the case of a change payment first system in which, for example at a POS register, the operator checks the payment (paper money+coin) which has been received from the client and inputs the amount of this inpayment by hand input, and performs inpayment of this payment which he has received after having first paid out an amount of change based thereupon by subtracting the sales price, since return of the paper money S to the client is never performed on the part of the machine, accordingly, for the recirculation cases 20 through 22, in order, the paper money S from the intermediate pool portions 20*a* through 22*a* is stored into the storage sections 20*b* through 22*b* On the other hand, in the case of an inpayment first and confirmation system in which the amount of money paid in is determined from the identification result by the inpayment identification unit 47, since there is a possibility of the machine performing a return to the client, the paper money S from the intermediate pool portion 20*a* through 22*a* is stored into the storage sections 20*b* through 22*b*, only on the condition that an inpayment confirmation action has been inputted.

It should be understood that, with regard to a 2,000 yen bill which can be paid in, but for which no recirculation case is provided, in the case of a change payment first system, the control unit 81 stops the conveyance unit 37 at the timing when the paper money bill S arrives at the abovementioned position at which its identification information detection has been completed, in concrete terms, at the timing when the detection of the paper money bill S over its entire long side direction by the various sensors for identifying the paper money bill S which are included in the inpayment identification unit 47 has been completed.

If, during this conveyance stoppage, that paper money bill S is identified by the inpayment identification unit 47 as being a 2,000 yen bill, then when, by performing opening operation of the separation unit 40G for the collection case 17, the control unit 81 has established a state in which it is possible to divert that paper money bill S into the collection case 17, the conveyance unit 37 is reversed, and that paper money bill S is stored in the collection case 17 via the conveyance path 40 which is branched off at the separation unit 40G.

Furthermore, in the case of a change payment first system, if any one of the recirculation cases 20 through 22 is in the full state, then the control unit 81 stops the conveyance unit 37 at the timing when a paper money bill S of this type which can be paid in arrives at the abovementioned position at which its identification information detection has been completed, in concrete terms, at the timing when the detection of the paper money bill S over its entire long side direction by the various sensors for identifying the paper money bill S which are included in the inpayment identification unit 47 has been completed. And when, during this stoppage of conveyance, that paper money bill S has been identified by the inpayment identification unit 47 as being paper money of that type whose collection case is in the fill state, then, by performing an opening operation of the separation unit 40G to the collection case 17, the control unit 81 puts the system into a state in which it is capable of diverting that paper money bill S into the collection case 17, and reverses the conveyance unit 37 so as to store that paper money bill S in the collection case 17 via the conveyance path 40 which branches off at the separation unit 40G.

On the other hand, if the paper money bill S is identified by the inpayment identification unit 47 as paper money which cannot be paid in, then the control unit 81 stops the conveyance unit 37 at the timing when the bill S arrives at the abovementioned position at which the identification information detection has been completed, in concrete terms, at the timing when the detection of the paper money bill S over its entire long side direction by the various sensors for identifying the paper money bill S which are included in the inpayment identification unit 47 has been completed. And when, during this stoppage of conveyance, that paper money bill S is detected by the inpayment identification unit 47 as being a paper money bill S which cannot be paid in, next, in the case of a change payment first system, the control unit 81 simply stores it in the collection case 17, since the inpayment has already been made by hand input, although it has been decided that an identification mistake has occurred. In other words when, by performing opening operation of the separation unit 40G towards the collection case 17, the system enters a state in which it is possible to divert that paper money bill S into the collection case 17, the control unit 81 reverses the conveyance unit 37 and conveys that paper money bill S to the collection case 17 via the conveyance path 40 which branches off at the separation unit 43G. Furthermore, in the case of an inpayment first and confirmation system, after the conveyance unit 37 has stopped as described above, when, by performing an opening operation of the separation unit 39G to the money output unit 16, the system has entered a state in which it is capable of diverting that paper money bill S to the money output unit 16, the control unit 81 reverses the conveyance unit 37 and conveys that paper money bill S to the money output unit 16 via the conveyance path 39 which branches off at the separation unit 39G. And thereby a state in which it is possible to remove the paper money bill S from the money output unit 16 to the exterior of the device is established, so that this bill S is returned to the operator. Thus, since these types of reverse conveyance are made possible, it is arranged for the conveyance unit 37 to convey only one paper money bill S at one time, and when, during such conveyance, the paper money bill S exits the conveyance unit 37, then the next paper money bill S is conveyed.

[Outpayment Processing]

During outpayment processing, a paper money bill S comes to be conveyed from one of the recirculation cases 20 through 22 via the main conveyance path 38 towards the money output unit 16, and when, during this conveyance along the main conveyance path 38, this paper money bill S is identified by the outpayment identification unit 48, the control unit 81 temporarily stops the conveyance by the conveyance unit 37 of that paper money bill S at the timing when it arrives at the position at which its identification information detection has been completed, in concrete terms, at the timing when the detection of the paper money bill S over its entire long side direction by the various sensors for identifying the paper money bill S which is included in the outpayment identification unit 48 has been completed. And when, during this conveyance stoppage, the paper money bill S is identified by the outpayment identification unit 48 as one which is being forwarded without being overlapped, next, by operating the separation unit 39G to open it so as to divert the paper money bill S to the money output unit 16, the control unit 81 establishes a state in which it is possible for that paper money bill S to be diverted to the money output unit 16, and then it restarts the conveyance of that paper money bill S by the conveyance unit 37. Due to this, that paper money bill S is fed into the money output unit 16 via the conveyance path 39 which branches off at the separation unit 39G. In this case, the outpayment identification unit 48 includes only an overlapping detection sensor, and only detects overlapping during forwarding.

On the other hand, if it has been detected by the outpayment identification unit 48 that these are paper money S which are overlapped during forwarding and cannot be paid out, then the control unit 81 stops the conveyance by the conveyance unit 37 at the timing when they arrive at the position at which their identification information detection has been completed, in concrete terms, at the timing when the detection of the paper money bills S over their entire long side direction by the various sensors for identifying the paper money bills S which are included in the outpayment identification unit 48 has been completed. And when, during this conveyance stoppage, it is detected by the outpayment identification unit 48 that these paper money bills S are paper money which are overlapped during its forwarding, then, by operating the separation unit 41G to open it so as to divert these paper money bills S to the rejected-for-payout case 18, the control unit 81 establishes a state in which it is possible for those paper money bills S to be diverted to the rejected-for-payout case 18, and then it reverses the conveyance unit 37, so as to convey those paper money bills S to the rejected-for-payout case 18 via the conveyance path 41 which branches off at the separation unit 41G.

By appropriately repeating the conveyance of paper money bills S to the money output unit 16, when the number of bills S which is required to be paid out is conveyed to the money output unit 16, the money output unit 16 is put into a state in which it is possible to take out those paper money bills S from the outpayment aperture 33 to the exterior of the device.

[Collection Processing]

During collection processing, a paper money bill S comes to be conveyed from some one of the recirculation cases 20 through 22 via the main conveyance path 38 towards the collection case 17, and when, during this conveyance along the main conveyance path 38, this paper money bill S is identified by the outpayment identification unit 48 as one which is not overlapped during this forwarding, the control unit 81 temporarily stops the conveyance of that paper money bill S by the conveyance unit 37 at the timing when it arrives at the position at which its abovementioned identification information detection has been completed, in concrete terms, at the timing when the detection of the paper money bill S over its entire long side direction by the various sensors for identifying the paper money bill S which are included in the outpayment identification unit 48 has been completed. And when, during this conveyance stoppage, the paper money bill S is identified by the outpayment identification unit 48 as one which is being forwarded without being overlapped, next, by operating the separation unit 40G to open it so as to divert the paper money bill S to the collection case 17, the control unit 81 establishes a state in which it is possible for that paper money bill S to be diverted to the collection case 17, and then it restarts the conveyance of that paper money bill S by the conveyance unit 37. Due to this, that paper money bill S is fed into the collection case 17 via the conveyance path 40 which branches off at the separation unit 40G. It should be understood that, according to requirements, the exchange of the collection case 17 may be repeated, while the amount of money to be collected is being checked by the outpayment identification unit 48.

On the other hand, if it has been detected by the outpayment identification unit 48 that these are paper money S which are overlapped during forwarding, then the control unit 81 temporarily stops the conveyance by the conveyance unit 37 at the timing when these bills arrive at the abovementioned position at which their identification information detection has been completed, in concrete terms, at the timing when the detection of the paper money bills S over their entire long side direction by the various sensors for identifying the paper money bills S which are included in the outpayment identification unit 48 has been completed. And when, during this conveyance stoppage, these paper money bills S are identified by the outpayment identification unit 48 as paper money which are overlapped during its forwarding, then by operating the separation unit 41G to open it to the rejected-for-payout case 18, the control unit 81 establishes a state in which it is possible for those paper money bills S to be diverted to the rejected-for-payout case 18, and then it reverses the conveyance unit 37, so as to convey those paper money bills S to the rejected-for-payout case 18 via the conveyance path 41 which branches off at the separation unit 41G. It should be understood that, after collection processing has been completed, the paper money bills S are taken out from the rejected for payment case 18 by hand. Furthermore, in the case of collecting the paper money bills in the paper money input and output device 11 while leaving a remainder, i.e. of collecting them while leaving a portion thereof for change payment next day or the like, then, in order to ascertain the number of bills in the recirculation cases 20 through 22, the above-described operation is repeated while omitting the left over amounts. Moreover if, as described above, three of the recirculation cases 20 through 22 are present, it may also be the case that, according to the type of paper money which is set for each of the recirculation cases 20 through 22, there may be a recirculation case for which the number of bills remaining is zero.

[Loading Processing]

When all of the paper money bills S have been collected from all of the recirculation cases 20 through 22, then, although loading processing is performed in which money required for change is loaded, this loading processing is performed in almost the same manner as the above-described inpayment processing.

Since, according to the paper money input and output device 11 of this embodiment as described above, the money input unit 15 to which paper money bills S are paid in from the exterior of the device, the money output unit 16 which releases paper money bills S from the interior of the device so that it becomes possible for them to be taken out to the exterior of the device, the plurality of recirculation cases 20 through 22 which, along with storing paper money bills S, output stored paper money bills S to the money output unit 16, the collection case 17 which can store paper money bills S from the money input unit 15 or the plurality of recirculation cases 20 through 22, and the rejected-for-payout case 18 which stores paper money bills S, among the paper money bills S which have been paid out from the recirculation cases 20 through 22, which have been rejected for outpayment, are provided in a stacked state in the thickness direction of the paper money which they receive, so that the thickness direction of the paper money is in the same direction, and the conveyance unit 37 is arranged so as to connect these together on one side only of a direction which is orthogonal with respect to the direction along which they are provided in a stacked state, accordingly it is possible to make the device as a whole more compact, because it does not all extend along the same direction. Moreover, since the conveyance unit 37 is disposed on the same side as all of the money input unit 15, the money output unit 16, the collection case 17, the rejected-for-payout case 18, and the plurality of recirculation cases 20 through 22, accordingly the directions for separating the bills to the various sections do not become complicated, and, while it is possible to suppress the occurrence of jamming during the conveyance of the paper money, even if by any unlikely chance a jam should occur, it is possible to eliminate this jam in a simple and easy manner, since access to the conveyance unit 37 is simple. In this case, such processing can be performed by opening up the side of the chassis 12 on the side of the conveyance unit 37.

Furthermore since, along with the money input unit 15, the money output unit 16, and the collection case 17 constituting, taken together, the first structural group 25, and the rejected-for-payout case 18 and the plurality of recirculation cases 20 through 22 constituting, taken together, the second structural group 26, the inpayment identification unit 47 which identifies the paper money which has been paid in is provided in the intermediate conveyance path 45 between the first structural group 25 and the second structural group 26, on the side of the first structural group 25, while the outpayment identification unit 48 which identifies the paper money which is to be paid out is provided at the side of the second structural group 26 in that intermediate conveyance path 45, accordingly, even though the intermediate conveyance path 45 may be short, along with it being possible to ensure an appropriate distance between the inpayment identification unit 47 and the recirculation case 20, which needs to be at least the length of one bill of paper money, it is also possible to ensure an appropriate distance between the outpayment identification unit 48 and the money output unit 16, which likewise needs to be at least the length of one bill of paper money, Accordingly, it is possible to shorten the length of the money input unit 15, the money output unit 16, the collection case 17, the rejected-for-payout case 18, and the plurality of recirculation cases 20 through 22 in their stacked direction by yet a further factor.

Furthermore if, for example, a paper money bill S which has been paid into the money input unit 15 and which is being conveyed by the conveyance unit 37 is identified by the inpayment identification unit 47 as being a paper money bill S which can be paid in, then it is stored in the corresponding one of the recirculation cases 20 through 22; while, if it is identified by the inpayment identification unit 47 as being a paper money bill S which cannot be paid in and must be rejected, then, by reversing the conveyance unit 37, it can be conveyed to the money output unit 16 or to the collection case 17. Furthermore, if for example a paper money bill S which has been stored in one of the recirculation cases 20 through 22 and which is being conveyed by the conveyance unit 37 is identified by the outpayment identification unit 48 as being a paper money bill S which can be paid out, then it is conveyed to the money output unit 16; while, if it is identified by the outpayment identification unit 48 as being a paper money bill S which cannot be paid out and must be rejected for payout, then, by reversing the conveyance unit 37, it can be conveyed to the rejected-for-payout case 18. Due to this, when the paper money bill S is identified as one which can be paid in or as one which can be paid out, the frequency of which occurrence is high, then, after the conveyance unit 37 has been stopped it is not reversed; however, when and only when the paper money bill S is identified as one which cannot be paid in and must be rejected for inpayment, or as one which cannot be paid out and must be rejected for outpayment, the frequency of which occurrence is low, then the conveyance unit 37 is reversed (switched back) after it has been stopped, and accordingly it is possible to suppress an increase in length of the processing time to the greatest possible degree.

Furthermore, due to the fact that the conveyance of a paper money bill S which is being conveyed from the money input unit 15 by the conveyance unit 37 is temporarily stopped by the control unit 81 based upon the timing by which that paper money bill S by the conveyance unit 37 is detected by the inpayment identification unit 47, and that the conveyance of that paper money bill S by the conveyance unit 37 is restarted, when a situation is established in which it is possible for that paper money bill S to be received by the corresponding one of the recirculation cases 20 through 22 for that type of money, accordingly it is not necessary to convey the paper money bill S during the time period from when its detection has been completed until its identification has been completed, so that thereby it is possible further to shorten the distance between the inpayment identification unit 47 and the recirculation cases 20 through 22. Accordingly, it is possible to shorten the length of the money input unit 15, the money output unit 16, the collection case 17, the rejected-for-payout case 18, and the plurality of recirculation cases 20 through 22 in their stacked direction by yet a further factor.

In addition, due to the fact that the conveyance of a paper money bill S which is being conveyed from one of the recirculation cases 20 through 22 by the conveyance unit 37 is temporarily stopped by the control unit 81 based upon the timing by which that paper money bill S by the conveyance unit 37 is detected by the outpayment identification unit 48, and that the conveyance of that paper money bill S by the conveyance unit 37 is restarted, when a situation is established in which it is possible for that paper money bill S to be received by the money output unit 16, accordingly it is not necessary to convey the paper money bill S during the time period from when its detection has been completed until its identification has been completed, so that thereby it is possible further to shorten the distance between the outpayment identification unit 48 and the money output unit 16. Accordingly, it is possible to shorten the length of the money input unit 15, the money output unit 16, the collection case 17, the rejected-for-payout case 18, and the plurality of recirculation cases 20 through 22 in their stacked direction by yet a further factor.

Furthermore since, in the first structural group 25, the money input unit 15, the money output unit 16, and the collection case 17 are stacked in that order, and moreover the collection case 17 is provided as the one closest to the second structural group 26, accordingly, while ensuring the convenience of use of the money input unit 15 and the money output unit 16, it is also possible to guarantee the distance between the outpayment identification unit 48 and the money output unit 16.

Additionally since, in the second structural group 26, the rejected-for-payout case 18 is provided as the one closest to the first structural group 25, accordingly it is possible to guarantee the distance between the inpayment identification unit 47 and the recirculation case 20.

It should be understood that it would also be possible, during outpayment, not to operate the separation unit 39G to open it to convey a paper money bill S to the outpayment aperture 33, after the paper money bill S has been detected by the outpayment identification unit 48, and the conveyance by the conveyance unit 37 has been temporarily stopped, and it has been checked that overlapped forwarding is not taking place, but rather, during outpayment, to operate the separation unit 39G to open it from the beginning. However if, even during outpayment, the separation unit 39G is put into the closed state from the beginning, by opening the separation unit 39G and conveying paper money to the money output unit 16 after the paper money bill S has been stopped, it becomes possible to decide whether or not the paper money bill S being conveyed when the error occurred is paper money S under machine management, or is paper money S taken as paid out, according to whether the separation unit 39G is in the open or the closed state. In other words, if the separation unit 39G is closed, the paper money bill S which is positioned directly before it is taken as being paper money S under machine management, whereas, if the separation unit 39G is open, even if there is a paper money bill S which is positioned directly before it, it is taken that this is a paper money bill S taken as paid out.

Figure 6:
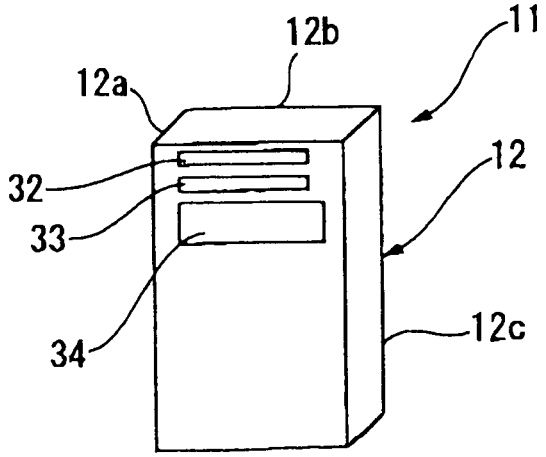
FIG. 6 is a perspective view, schematically showing a variant example of this paper money input and output device according to the first embodiment of the present invention.

Although, in the above-described embodiment, by way of example, the explanation assumes the device to be set up so that the shortest edge portions 12*a* of the chassis 12 are oriented along the height direction, the edge portions of intermediate length 12*b* are oriented along the widthwise direction, and the longest edge portions 12*c* are oriented along the depth direction, it would also be possible, as shown in FIG. 6, to set up the device so tat the shortest edge portions 12*a* are oriented along the depth direction, the edge portions of intermediate length 12*b* are oriented along the widthwise direction, and the longest edge portions 12*c* are oriented along the height direction.

Figure 7:
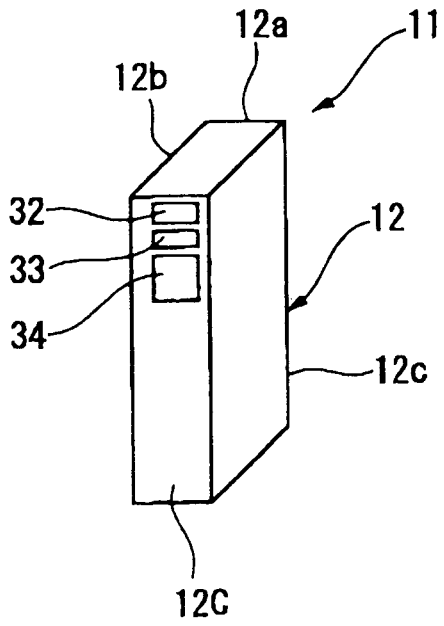
FIG. 7 is a perspective view, schematically showing another variant example of this paper money input and output device according to the first embodiment of the present invention.
Figure 8:
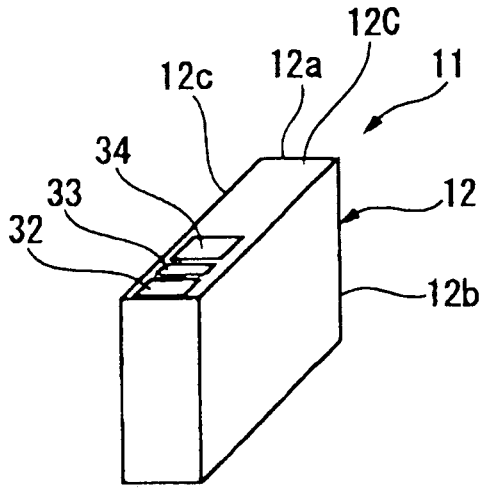
FIG. 8 is a perspective view, schematically showing yet another variant example of this paper money input and output device according to the first embodiment of the present invention.

Furthermore, as shown in FIG. 7, it would also be acceptable to arrange the shortest edge portion 12*a* of the chassis 12 in the widthwise direction, its edge portions of intermediate length 12*b* in the depth direction, and its longest edge portions 12*c* in the height direction, by opening the inpayment aperture 32 of the money input unit 15 and the outpayment aperture 33 of the money output unit 16 in its surface portion 12C which is defined by the shortest edge portions 12*a* and the longest edge portions 12*c*. Furthermore, as shown in FIG. 8, it would also be possible to arrange the shortest edge portions 12*a* of the chassis 12 in the widthwise direction, its edge portions of intermediate length 12*b* in the height direction, and its longest edge portions 12*c* in the depth direction. It should be understood that, in these cases, since it is necessary to exchange the money input unit 15 and the money output unit 16, this corresponds to changing them by opening the lid portion 30 and exchanging the single unit 28, including the first structural portion 25, for another. Furthermore, in these cases, along with the paper money bills S being paid in and paid out along their long side directions, the conveyance unit 37 also comes to convey the paper money bills S along their long side directions.

Furthermore, the above-described inpayment aperture 32 and outpayment aperture 33 may be made as common money input and output apertures. Yet further, the above-described paper money input and output device 11 may be reversed left for right, so that the conveyance unit 37 is located on the opposite side in the widthwise direction to the one described above.

Next, a paper money input and output device according to a second embodiment of the present invention will be explained with reference to the drawings.

Figure 9:
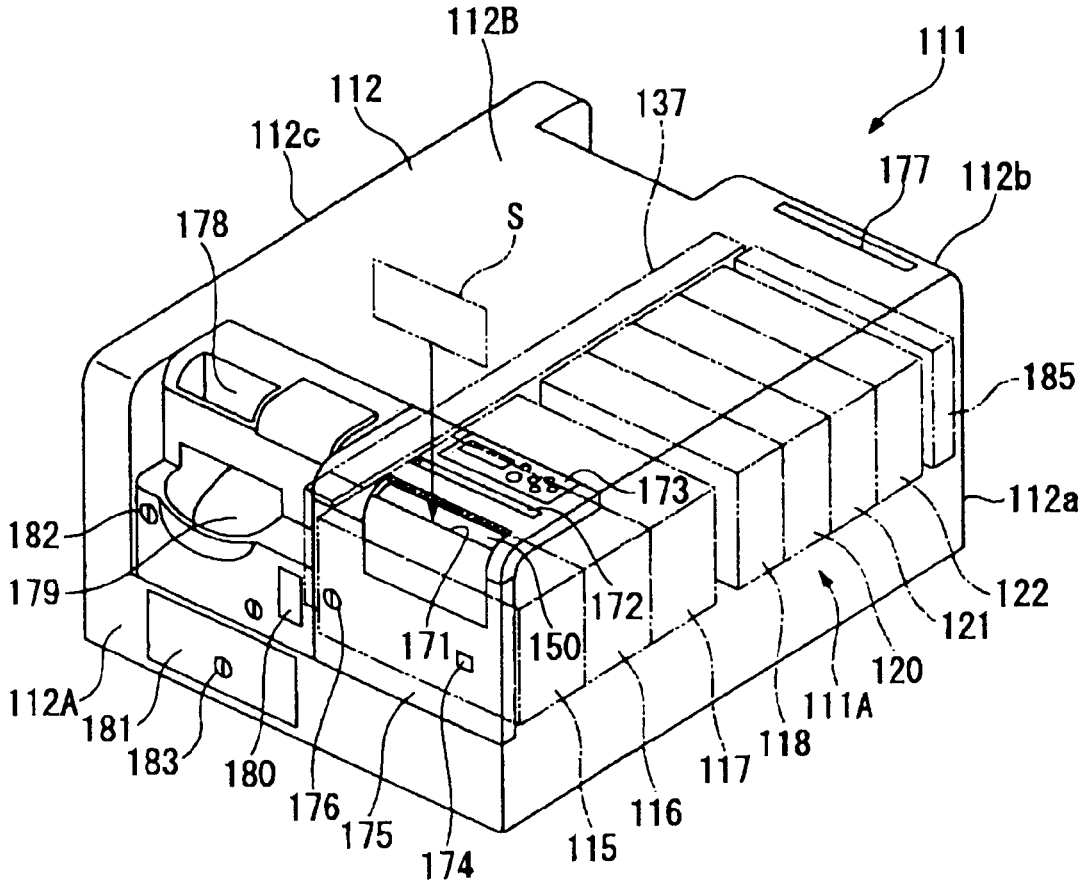
FIG. 9 is a perspective view, schematically showing a paper money input and output device according to a second embodiment of the present invention, as seen from its front upper side.

A paper money input and output device 111 of this second embodiment is one which is set up, for example, near a POS register, and which performs inpayment of sales takings and outpayment of change, and, as shown in FIG. 9, in a chassis 112 which is shaped approximately as a rectangular parallelepiped, it is integrally provided with money input and output devices. This chassis 112 is used while oriented so that its shortest edge portions 112*a* are oriented in the height direction, its next shortest portions of intermediate length 112*b* are oriented in the widthwise direction (the left and right direction), and its longest edge portions 112*c* are oriented in the depth direction. Due to this, in the chassis 112, its front surface (one of its sides) 112A which is closest to and faces the operator is oriented in letterbox format and is surrounded by the shortest edge portions 112*a* and the edge portions of intermediate length 112*b*, while its upper surface 112B is surrounded by the edge portions of intermediate length 112*b* and the longest edge portions 112*c*. It should be understood that the terms "height direction", "widthwise direction", and "depth direction" used in the following explanation are not particularly limitative; they indicate the height direction, the widthwise direction, and the depth direction of the chassis 112.

A paper money input and output mechanism 111A which performs input and output of paper money bills S is located in, approximately, its right side half portion as seen from the front surface 112A of the chassis 112 (its surface which faces the operator), and a coin input and output mechanism (not shown in the figure) which performs input and output of coins is located in, approximately, its left side half portion.

Figure 10:
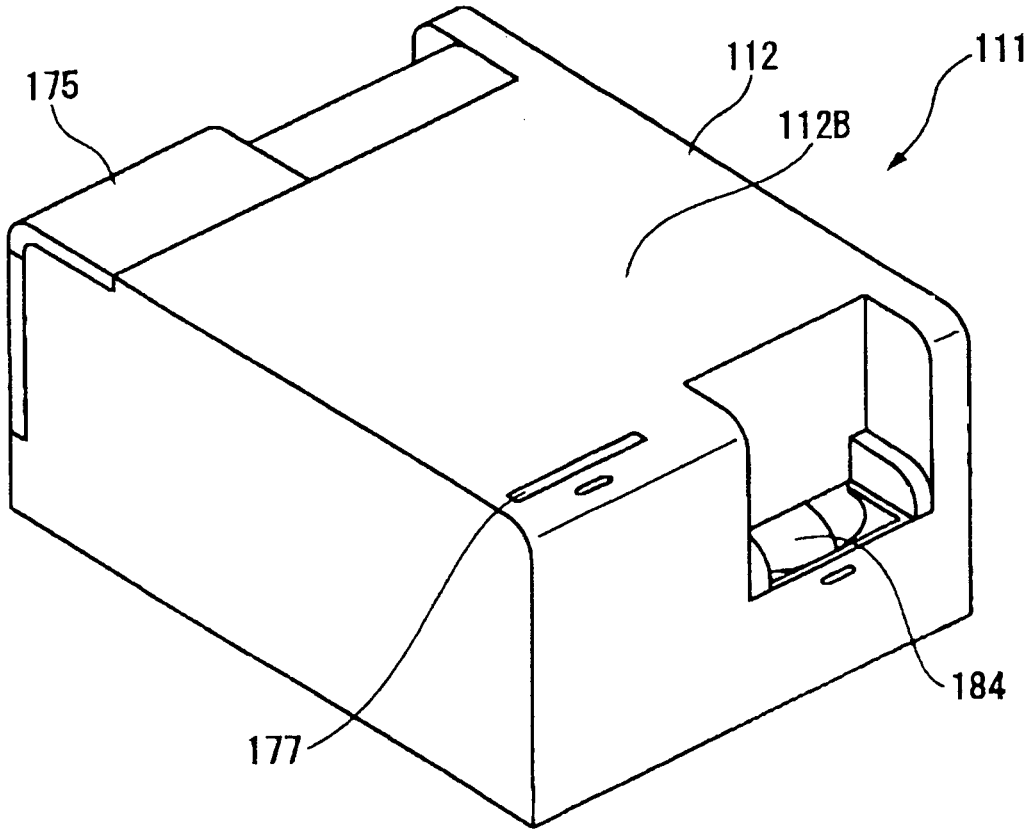
FIG. 10 is a perspective view, schematically showing this paper money input and output device according to the second embodiment of the present invention, as seen from its rear upper side.

In the upper portion of the front surface side 1112A of the chassis 112, on the paper money input and output mechanism 111A side, in order from the front surface 112A, there are provided a paper money inpayment aperture 171 which is an opening on the top into which paper money bills S in bulk are paid in from the exterior of the device, a paper money outpayment aperture 172 which allows paper money bills S, released from the interior of the device, to be removed to the exterior of the device, and an operation and display section 173 which, along with receiving operational input from the operator, also provides a display to the operator. Furthermore, in the front surface 112A of the paper money input and output mechanism 111A side of the chassis 112, there are provided a power supply switch 174 and a key cylinder 176 for opening and closing a front surface cover 175 of the chassis 112. Moreover, as shown in FIG. 10, a paper money rear side outpayment aperture 177, which permits paper money bills S, released from the interior of the device, to be removed to the exterior of the device, is provided on the upper portion of the rear surface side of the chassis 112, on the paper money input and output mechanism 111A side thereof.

On the other hand, in the upper portion of the front surface side of the coin input and output mechanism side of the chassis 112 (its left side as seen from the side of the front surface 112A), there is provided a coin inpayment aperture 178 which is an opening on the top in which bulk coins are paid in from the exterior of the device, and, in a position on the front surface 112A of the chassis 112 which corresponds to this coin inpayment aperture 178, there are provided a coin front surface side outpayment aperture 179 from which it is possible to receive coins which have been released from the interior of the device and to pass them out to the exterior of the device, and a coin reject aperture 180 which releases coins which cannot be received. Furthermore, in the front surface 112A of the chassis 112, below the coin front surface side outpayment aperture 179, there is provided a coin cassette 181 which can be slid so as to be opened and closed. A key cylinder 182 is provided for opening and closing the front surface side of this coin input and output mechanism of the chassis 112 during maintenance. Furthermore, a key cylinder 183 is provided for locking the coin cassette 181 to the chassis 112. Moreover, as shown in FIG. 10, a coin rear side outpayment aperture 184 is provided on the rear surface of the coin input and output mechanism side of the chassis 112, and this makes it possible to receive coins which have been released from the interior of the device and to pass them out to the exterior of the device.

In the following, the paper money input and output mechanism 111A in the chassis 112 will be explained.

Figure 11:
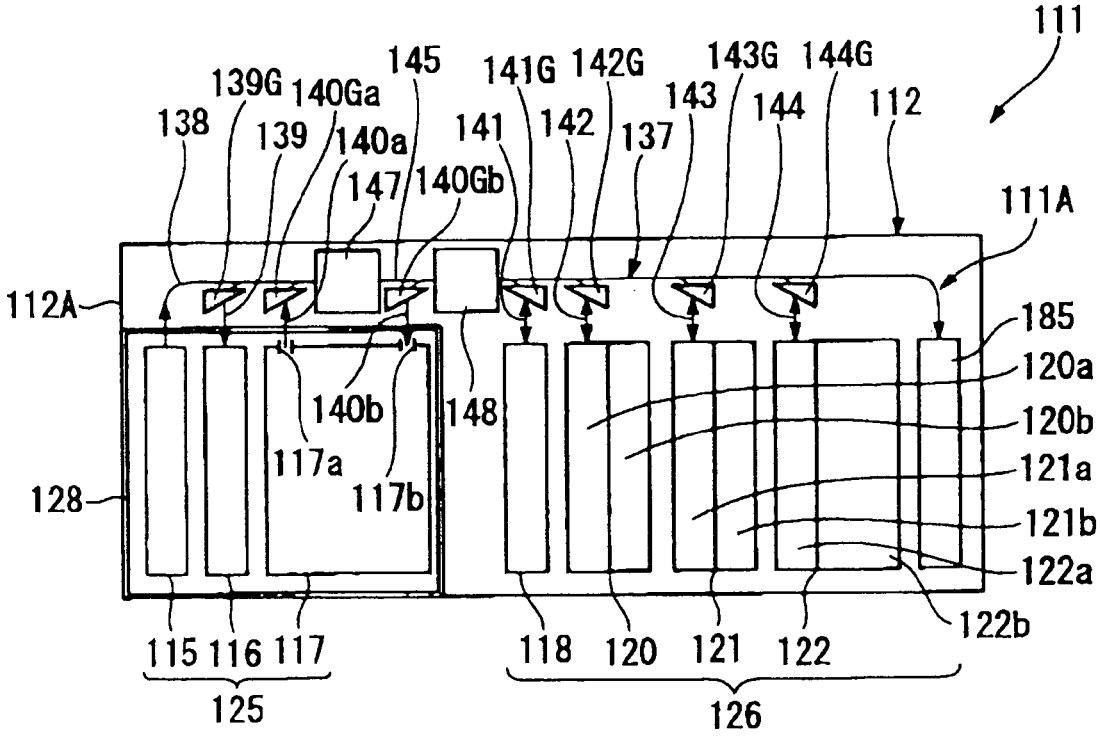
FIG. 11 is a horizontal sectional view, schematically showing this paper money input and output device according to the second embodiment of the present invention.

As shown in FIGS. 9 and 11, in this chassis 112, there are arranged, in order along its depth direction from the side of its front surface 112A: a money input unit 115 of which the top can be opened in order for paper money bills S to be paid in from the paper money inpayment aperture 171, a money output unit 116 which releases to the paper money outpayment aperture 172 paper money bills S which have been sent from the interior of the device; a removable replenishment and collection case 117 which performs replenishment of paper money bills S from the exterior of the device to the interior of the device and collection of paper money S in the interior of the device; a non-detachable rejected-for-payout case 118 which stores paper money which has been rejected for pay-out; a plurality, in concrete terms three, of non-detachable recirculation cases, i.e. a recirculation case 120, a recirculation case 121, and a recirculation case 122, which, along with storing paper money bills S, pay out stored paper money bills S to the money output unit 116; and a rear side money output unit 185 which releases to the paper money rear side outpayment aperture 177 paper money bills S which have been sent from the interior of the device.

In this structure, at the front surface 112A, the money input unit 115, the money output unit 116, and the replenishment and collection case 117 together constitute a first structural group 125, while, at the opposite end to the front surface 112A, the rejected-for-payout case 118, the recirculation case 120, the recirculation case 121, the recirculation case 122, and the rear side money output unit 185 together constitute a second structural group 126. Due to this, in the first structural group 125, the money input unit 115, the money output unit 116, and the replenishment and collection case 117 are arranged in that order, and moreover the replenishment and collection case 117 comes to be the unit which is provided most towards the second structural group 126; while, in the second structural group 126, the rejected-for-payout case 118 comes to be the unit which is provided most towards the first structural group 125.

It should be understood that the money input unit 115, the money output unit 116, and the replenishment and collection case 117 of the first structural group 125 are made as a single unit 128, and this unit 128 can be fitted and detached by opening and closing the front surface cover 175 of the chassis 112. Furthermore, the replenishment and collection case 117 is made as a cassette type unit, and can be fitted to and detached from the unit 128. This cassette type replenishment and collection case 117, along with being provided with an outpayment aperture 117*a* for replenishing paper money into the recirculation cases 120, 121, and 122 and with a collection aperture 117*b* for collection of paper money S from the interior of the device, also comprises, in its interior, a paper money storage section not shown in the figures, and a paper money loading mechanism also not shown in the figures which loads paper money which has been collected from the collection aperture 117*b* into the paper money storage section. It should be understood that it is arranged for this replenishment and collection case 117 to be positioned, in a state in which it is fitted in the interior of the device, with its outpayment aperture 117*a* to the front side (the operator side), so that the collection aperture 117*b* is to the rear side (the opposite side to the operator).

Each of the above-described money input unit 115, money output unit 116, replenishment and collection case 117, rejected-for-payout case 118, recirculation case 120, recirculation case 121, recirculation case 122, and rear side money output unit 185 has a shape which is of letterbox format in the widthwise direction, just like the front surface 112A, and, along with all of them positionally mutually matching one another in the widthwise direction and the height direction, it is arranged for them to receive paper money S which is inserted in a standing state with its short side direction extending along the height direction and with its long side direction extending along the widthwise direction. In other words, the money input unit 115, the money output unit 116, the replenishment and collection case 117, the rejected-for-payout case 118, the recirculation cases 120 through 122, and the rear side money output unit 185 are provided in a stacked state (i.e. matched along the depth direction), and so that the thickness directions of the paper money S put into them all lie along that same direction.

The above-described money input unit 115, money output unit 116, replenishment and collection case 117, rejected-for-payout case 118, recirculation cases 120 through 122, and rear side money output unit 185 are provided up against one side in the widthwise direction within the chassis 112, and, in a space which is thereby defined at the other side in the widthwise direction of the chassis 112, there is provided a conveyance unit 137 which connects together the money input unit 115, the money output unit 116, the collection case 117, the rejected-for-payout case 18, the recirculation cases 120 through 122, and the rear side money output unit 185, and performs exchange of paper money S between them. In other words, this conveyance unit 137 is disposed on only one side in the widthwise direction, which is a direction which is orthogonal to the depth direction, which is the direction along which the money input unit 115, the money output unit 116, the replenishment and collection case 117, the rejected-for-payout case 118, the recirculation case 120, the recirculation case 121, the recirculation case 122, and the rear side money output unit 185 are stacked. It should be understood that this conveyance unit 137 is one which rotates forward and backward under the control of a controller not shown in the figures, and it conveys the paper money S in a standing state, with its long side direction always extending along the direction of conveyance and its short side direction extending in the vertical direction. And a drive system not shown in the figures is located under the money input unit 115, the money output unit 116, the replenishment and collection case 117, the rejected-for-payout case 118, the recirculation cases 120 through 122, and the rear side money output unit 185 for driving them, this drive system being controlled by the controller, just like the conveyance unit 137.

The conveyance unit 137, as shown in FIG. 11, comprises: a main conveyance path 138 which connects between the money unit 115 at the side of the front surface 112A, and the rear side money output unit 185 at the rear surface side. A branched off conveyance path 139 branches off from the main conveyance path 138 in the neighborhood of the money output unit 116, and is connected to the money output unit 116. A branched off conveyance path 140*a* branches off from the main conveyance path 138 at the front end portion of the neighborhood of the replenishment and collection case 117 and is connected to the outpayment aperture 117*a* of the replenishment and collection case 117. A branched off conveyance path 140*b* branches off from the main conveyance path 138 at the rear end portion of the neighborhood of the replenishment and collection case 117 and is connected to the collection aperture 117*b* of the replenishment and collection case 117. A branched off conveyance path 141 branches off from the main conveyance path 138 in the neighborhood of the rejected-for-payout case 118, and is connected to the rejected-for-payout case 118. A branched off conveyance path 142 branches off from the main conveyance path 138 in the neighborhood of the recirculation case 120 and is connected to the recirculation case 120. A branched off conveyance path 143 branches off from the main conveyance path 138 in the neighborhood of the recirculation case 121 and is connected to the recirculation case 121. And a branched off conveyance path 144 branches off from the main conveyance path 138 in the neighborhood of the recirculation case 122 and is connected to the recirculation case 122.

Furthermore, the conveyance unit 137 comprises separation units 139G, 140G*b*, and 140G*a*. The separation unit 139G, on the one hand, in the opened state, conveys paper money S transported via the main conveyance path 138 which has arrived from the side of the second structural group 126 to the money output unit 116, by guiding it into the branched off conveyance path 139 which is connected to the money output unit 116; while, on the other hand, in the closed state, it conveys the paper money S just as it is via the main conveyance path 138. The separation unit 140G*b*, on the one hand, in the opened state, conveys paper money S transported via the main conveyance path 138 which has arrived from the side of the second structural group 126 to the replenishment and collection case 117, by guiding it into the branched off conveyance path 140*b* which is connected to the collection aperture 117*b* of the replenishment and collection case 117; while, on the other hand, in the closed state, it conveys the paper money S just as it is via the main conveyance path 138. And the separation unit 140G*a*, on the one hand, in the opened state, connects the branched off conveyance path 140*a* which is connected to the outpayment aperture 117*a* of the replenishment and collection case 117 to the second structural group 126 side of the main conveyance path 138, so as to release paper money bills S from the replenishment and collection case 117; while, on the other hand, in the closed state, it permits the paper money S to pass through the main conveyance path 138.

Moreover, the conveyance unit 137 comprises separation units 141G, 142G, 143G, and 144G. The separation unit 141G on the one hand, in the opened state, conveys paper money S transported via the main conveyance path 138 which has arrived from the side of the first structural group 125 to the rejected-for-payout case 118, by guiding it into the branched off conveyance path 141 which is connected to the rejected-for-payout case 118; while, on the other hand, in the closed state, it conveys the paper money S just as it is via the main conveyance path 138. The separation unit 142G, on the one hand, in the opened state, conveys paper money S transported via the main conveyance path 138 which has arrived from the side of the first structural group 125 to the recirculation case 120, by guiding it into the branched off conveyance path 142 which is connected to the recirculation case 120; while, on the other hand, in the closed state, it conveys the paper money S just as it is via the main conveyance path 138. The separation unit 143G, on the one hand, in the opened state, conveys paper money S transported via the main conveyance path 138 which has arrived from the side of the first structural group 125 to the recirculation case 121, by guiding it into the branched off conveyance path 143 which is connected to the recirculation case 121; while, on the other hand, in the closed state, it conveys the paper money S just as it is via the main conveyance path 138. And the separation unit 144G, on the one hand, in the opened state, conveys paper money S transported via the main conveyance path 138 which has arrived from the side of the first structural group 125 to the recirculation case 122, by guiding it into the branched off conveyance path 144 which is connected to the recirculation case 122; while, on the other hand, in the closed state, it conveys the paper money S just as it is via the main conveyance path 138. It should be understood that the above-described separation units 139G through 144G are normally in the closed state, and, when required, are put into the opened state by being driven by the controller.

Here, the recirculation case 120 comprises an intermediate pool portion 120*a*, on the side of the front surface 112A, which temporarily accumulates paper money which has been received and inputted from the branched conveyance path 142, and a storage section 120*b*, at the opposite side from the front surface 112A, which stores paper money S from the intermediate pool portion 120*a*; and it is capable of outputting paper money S which is stored in the storage section 120*b* to the branched off conveyance path 142. In the same manner, the recirculation case 121 comprises an intermediate pool portion 121*a*, on the side of the front surface 112A, which temporarily accumulates paper money which has been received and inputted from the branched conveyance path 143, and a storage section 121*b*, at the opposite side from the front surface 112A, which stores paper money S from the intermediate pool portion 121*a*; and it is capable of outputting paper money S which is stored in the storage section 121*b* to the branched off conveyance path 143. Also similarly, the recirculation case 122 comprises an intermediate pool portion 122*a*, on the side of the front surface 112A, which temporarily accumulates paper money which has been received and inputted from the branched off conveyance path 144, and a storage section 122*b*, at the opposite side from the front surface 112A, which stores paper money S from the intermediate pool portion 122*a*; and it is capable of outputting paper money S which is stored in the storage section 122*b* to the branched off conveyance path 144. It should be understood that the amount of storage provided by the storage section 122*b* of the recirculation case 122, which is the one furthest away from the first structural group 125, is larger than the amounts provided by the storage sections 120*b*, 121*b* of the other recirculation cases 120, 121, so that it is arranged for this storage section 122*b* to store the type of paper money S of which it is required to handle the greatest amount, i.e. 1,000 yen notes. Furthermore, it is arranged for the recirculation case 120, which is the one closest to the first structural group 125, to store some other type of paper money S, for example 10,000 yen notes; while it is arranged for the intermediate recirculation case 121 to store yet another type of paper money S, for example 5,000 yen notes.

An inpayment identification unit 147 and an outpayment identification unit 148 are provided in the intermediate conveyance path 145, between the position where the branched off conveyance path 140*a* on the side first structural group 125 branches off from the main conveyance path 138 and the position where the branched off conveyance path 141 on the side of the second structural group 126 branches off there from. The inpayment identification unit 147 identifies paid in paper money S during its conveyance from the side of the first structural group 125 toward the side of the second structural group 126, while the outpayment identification unit 148 is more towards the side of the second structural group 126 than the inpayment identification unit 147, and identifies overlapped forwarding and so on of paper money S for outpayment, during its conveyance from the side of the second structural group 126 to the side of the first structural group 125.

It should be understood that, so as to make it possible to stop the conveyance of the paper money S which has been identified by the inpayment identification unit 147 before it arrives at the nearest recirculation case 120, i.e., in more concrete terms, at the branching off position of the branched off conveyance path 142, the distance from the position at which identification information detection by the inpayment identification unit 147 is completed to the recirculation case 120 which is the closest one to the side of the front surface 112A, i.e., in more concrete terms, to the branching off position of the branched off conveyance path 142, is set to be a distance equal to "the maximum length of the long side of the paper money S"+"the conveyance distance during the amount of time required for the conveyance unit 137 to stop upon application of braking by the conveyance unit 137". And, in order to make it possible to stop the conveyance of the paper money S which has been identified by the outpayment identification unit 148 before it arrives at the money output unit 116, i.e., in more concrete terms, at the branching off position of the branched off conveyance path 139, the distance from the position at which identification information detection by the outpayment identification unit 148 is completed to the money output unit 116, i.e., in more concrete terms, to the branching off position of the branched off conveyance path 139, is also set to be a distance equal to "the maximum length of the long side of the paper money S"+"the conveyance distance during the amount of time required for the conveyance unit 137 to stop upon application of braking by the conveyance unit 37". And the positions of the inpayment identification unit 147 and the outpayment identification unit 148 in the intermediate conveyance unit 145 are set so as to ensure these distances, and the gap between the first structural group 125 and the second structural group 126 is set based thereupon.

Figure 12C:
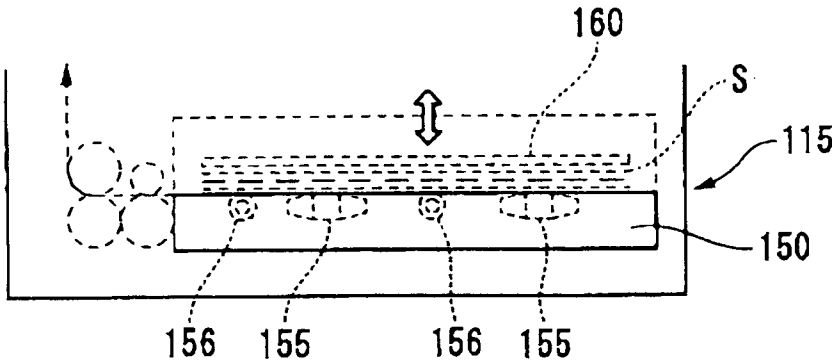
FIGS. 12A, 12B, and 12C are respectively an elevation view, a side view, and a plan view, schematically showing a money input unit of this paper money input and output device according to the second embodiment of the present invention.
Figure 12B:
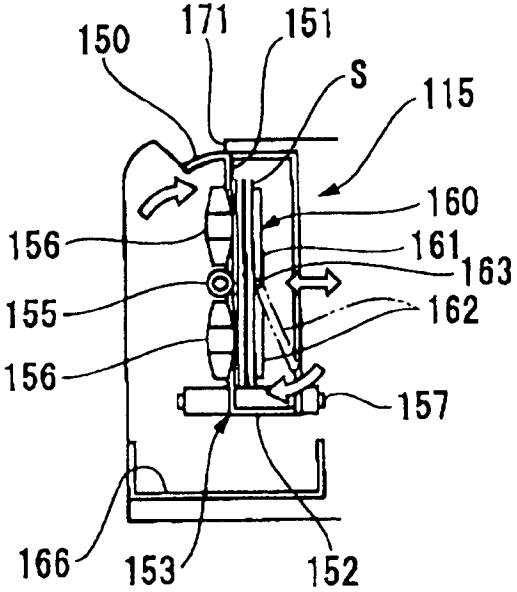
Figure 12A:
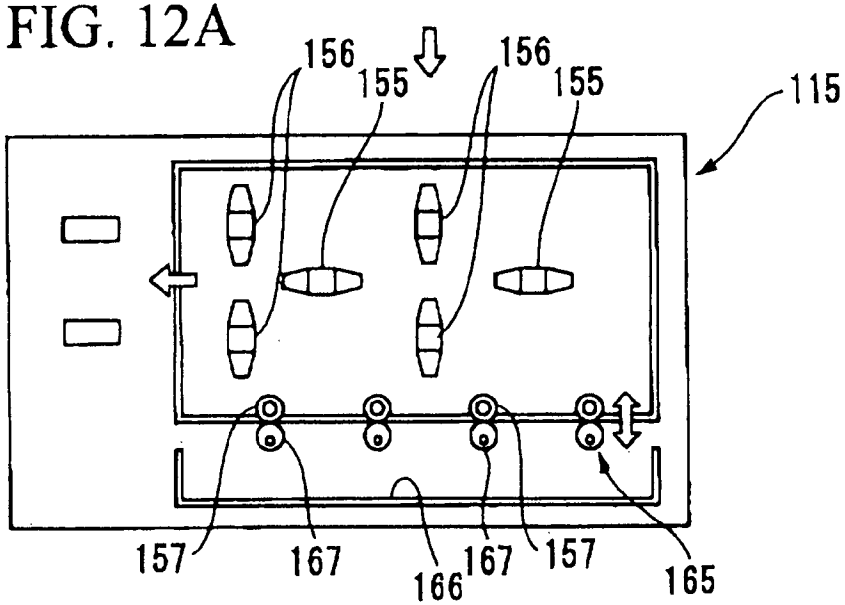

The money input unit 115, as shown in FIGS. 12A through 12C, is provided with a tiltable reception stand 153 for receiving a paper money bill S which has been paid in, set to a position underneath and deeper than the paper money inpayment aperture 171. This reception stand 153 is supported upon a base portion not shown in the drawings so that a wall plate portion 151 thereof can be rotated in the depth direction, and, along with being provided integrally with a shutter 150 for opening and closing the paper money inpayment aperture 171 at the upper end portion of this wall plate portion 151, is also provided with a bottom plate portion 152 and guide rollers 157 at its lower end portion.

In the wall plate portion 151, along with shift rollers 155 being provided with their rotational axes being oriented along the widthwise direction, also forwarding rollers 156 are provided with their central axial lines oriented along the vertical direction. The shift rollers 155 pull in a paper money bill S which has been paid in from the paper money inpayment aperture 171 towards the side of the bottom plate portion 152, and the forwarding rollers 156 are for forwarding out the paper money bill S which has thus been pulled in to the bottom plate portion 152 to the main conveyance path 138 on the side; and tapered surfaces are provided on both sides of the axial directions of these rollers 155 and 156, for smoothing out the forwarding of the paper money bill S. The guide rollers 157 are provided at positions higher than the bottom plate portion 152, with their rotational axes oriented in the depth direction, and they catch the lower end of a paper money bill S which has been pulled in by the shift rollers 155, so as to guide the forwarding of the paper money bill S by the forwarding rollers 156.

Furthermore, this money input unit 115 comprises a bill press 160 which is provided at the deep side of the wall plate portion 151 in the depth direction, and this bill press 160 comprises an upper plate portion 161 which is always oriented orthogonally with respect to the depth direction, and a lower plate portion 162 whose upper edge portion is rotatably supported on the lower edge portion of this upper plate portion 161, around a shaft 163 extending along the widthwise direction as a center.

Furthermore, a shaking mechanism 165 which vibrates the reception stand 153 vertically and thereby causes any foreign bodies to fall out from the paper money S is provided at the money input unit 115, and a foreign body reception tray 166 is provided under the guide rollers 157, which receives any foreign bodies which fall out from the paper money S. Here, the shaking mechanism 165 comprises a plurality of eccentric rollers 167 which are contacted against the reception stand 153 from underneath, and the reception stand 153 is caused to vibrate in the vertical direction by these eccentric rollers 167 being rotated.

Figure 13:
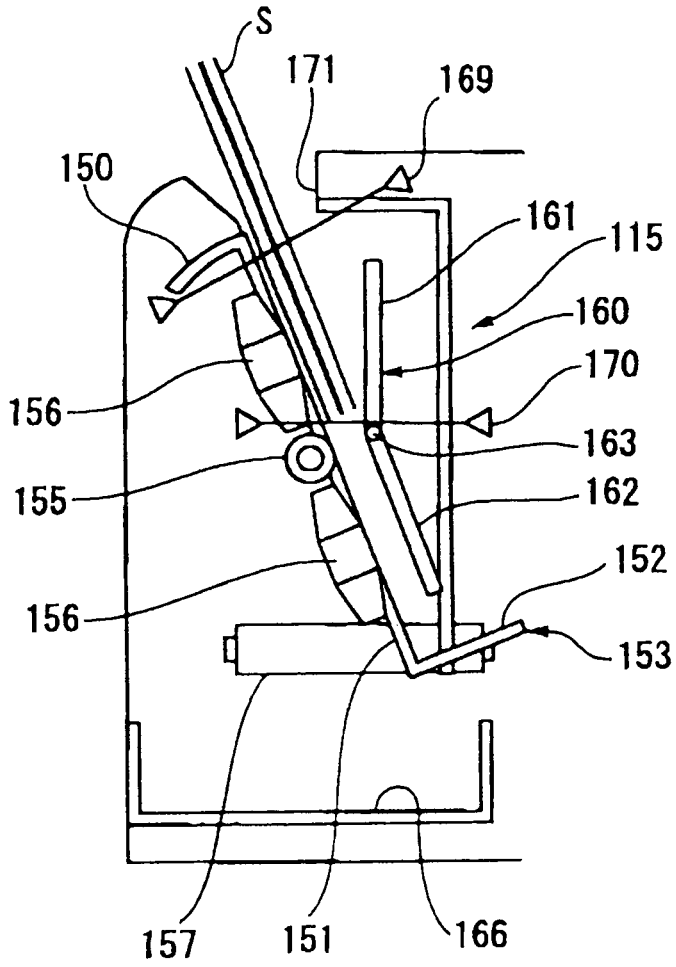
FIG. 13 is a side view schematically showing this money input unit of the paper money input and output device according to the first embodiment of the present invention, and shows a situation in which a reception stand is tilted.

In addition, as shown in FIG. 13, the money input unit 115 is provided, in its upper portion, with a sensor 169 for detecting the timing of drive stopping of the shift rollers 155, and, in its intermediate portion, with a sensor 170 for detecting the timing of drive starting of the shift rollers 155.

In its initial state, the above-described reception stand 153 is in a state in which the wall plate portion 151 is kept in a vertical attitude, and it is tilted forwards by the operation of an actuator not shown in the drawings at the timing at which paper money S is paid in from the inpayment aperture 132, so that, at this time, the shutter 150 which is provided at its upper end portion opens the paper money inpayment aperture 171. Accordingly, a paper money bill S comes to be paid in to the money input unit 115 in the state in which the reception stand 153 is tilted. And when, by doing this, the paper money bill S is paid in to the money input unit 115, as previously described, the shift rollers 155 pull in the paper money bill S to a position in which it contacts against the guide rollers 157, and thereafter the reception stand 153 is returned to its initial state by the actuator as shown in FIG. 12B, so that, at the same time, the paper money inpayment aperture 171 is closed by the shutter 150. After this, the paper money bill S is vibrated by the shaking mechanism 165, and then the lower plate portion 162 of the bill press 160 is rotated and is contacted against the paper money bill S, so that the paper money bill S is forwarded out into the main conveyance path 138 by the forwarding rollers 156.

It should be understood that the money output unit 116 and the rear side money output unit 185 have almost the same structure as the money input unit 115: paper money S which has been fed in from the main conveyance path 138 is further pulled in towards the reception stand by the forwarding rollers, and the reception stand is tilted, and the paper money S is projected upwards by the shift rollers from the paper money outpayment aperture 172 or the paper money rear side outpayment aperture 177, so that it becomes possible to take it out.

Each of the processes in the operation of the paper money input and output device 111 according to this second embodiment, having the structure described above, will now be separately explained.

[Inpayment Processing]

During inpayment processing, by the controller rotating the reception stand 153 of the money input unit 115, in this state, paper money bills S may be paid in from the inpayment aperture 171 in a standing state, with their short side direction extending along the height direction and with their long side direction extending along the widthwise direction. When the fact that paper money bills S have been paid in to the inpayment aperture 171 has been detected by the sensor 170, the controller pulls in the paper money bills S with the shift rollers 155; and, when the fact that the paper money bills S have been pulled in to a position in which they contact against the guide rollers 157 has been detected by the sensor 169, the shift rollers 155 are stopped; and, after the reception stand 53 has been returned so that its wall plate portion 151 becomes vertical, the paper money S is shaken with the shaking mechanism 165; and, thereafter, the lower plate portion 162 of the bill press 160 is rotated, and the paper money S is forwarded out into the main conveyance path 138 one bill at a time, separately, by the forwarding rollers 156 which are contacted against the paper money S.

The paper money bill S which has thus been forwarded out into the main conveyance path 138 is identified, during its conveyance, by the inpayment identification unit 147, but the controller temporarily stops the conveyance of that paper money bill S by the conveyance unit 137, at the timing when it arrives at the above-mentioned position at which its identification information detection has been completed, in concrete terms, at the timing when the detection of that paper money bill S over its entire long side direction by the various sensors for identifying the paper money bill S which are included in the inpayment identification unit 147 has been completed. And when, during this stoppage of conveyance, the paper money bill S has been identified by the inpayment identification unit 147 as being proper for inpayment, next, by the controller performing, according to requirements, opening operation of that one, among the separation units 142G, 143G, and 144G for the recirculation cases 120 through 122, for diversion of the corresponding type of money, when a state has been established in which that paper money bill S can be passed into the corresponding one among the recirculation cases 120 through 122 for the different types of money, then the conveyance of that paper money bill S by the conveyance unit 137 is restarted. By doing this, that paper money bill S is stored in the one among the recirculation cases 120 through 122 for the various types of money, which corresponds to that type of money. Thus, if the type of bill is a 1,000 yen note which can be paid in, then this is accumulated in the intermediate pool portion 122*a* of the recirculation case 122 via the conveyance path 144 which is branched off at the separation unit 144G; while, if the type of bill is a 10,000 yen note which can be paid in, then this is accumulated in the intermediate pool portion 210*a* of the recirculation case 120 via the conveyance path 142 which is branched off at the separation unit 142G; and, if the type of bill is a 5,000 yen note which can be paid in, then this is accumulated in the intermediate pool portion 121*a* of the recirculation case 121 via the conveyance path 143 which is branched off at the separation unit 143G.

Thus, in the case of a change payment first system in which, for example at a POS register, the operator checks the payment (paper money+coin) which has been received from the client and inputs the amount of this inpayment by hand, and performs inpayment of this payment which he has received after having first paid out an amount of change based thereupon by subtracting the sales price, since return of the paper money S to the client is never performed on the part of the machine, accordingly, for the recirculation cases 120 through 122, in order, the paper money S from the intermediate pool portions 120*a* through 122*a* is stored into the storage sections 120*b* through 122*b*. On the other hand, in the case of an inpayment first and confirmation system in which the amount of money paid in is determined from the identification result by the inpayment identification unit 147, since there is a possibility of the machine performing a return to the client, the paper money S from the intermediate pool portion 120*a* through 122*a* is stored into the storage sections 120*b* through 122*b*, only on the condition that an inpayment confirmation action has been inputted.

It should be understood that, with regard to a 2,000 yen bill which can be paid in, but for which no recirculation case is provided, in the case of a change payment first system, the controller stops the conveyance unit 137 at the timing when the paper money bill S arrives at the above-mentioned position at which its identification information detection has been completed, in concrete terms, at the timing when the detection of the paper money bill S over its entire long side direction by the various sensors for identifying the paper money bill S which are included in the inpayment identification unit 147 has been completed.

If, during this conveyance stoppage, that paper money bill S is identified by the inpayment identification unit 147 as being a 2,000 yen bill, then when, by performing opening operation of the separation unit 140G*b* to the collection aperture 117*b* for the replenishment and collection case 117, the controller has established a state in which it is possible to divert that paper money bill S into the replenishment and collection case 117, the conveyance unit 137 is reversed, and that paper money bill S is stored in the replenishment and collection case 111 via the conveyance path 140*b* which is branched off at the separation unit 140G*b*.

Furthermore, in the case of a change payment first system, if any one of the recirculation cases 120 through 122 is in the full state, then the controller stops the conveyance unit 137 at the timing when a paper money bill S of this type which can be paid in arrives at the above-mentioned position at which its identification information detection has been completed, in concrete terms, at the timing when the detection of the paper money bill S over its entire long side direction by the various sensors for identifying the paper money bill S which are included in the inpayment identification unit 147 has been completed. And when, during this stoppage of conveyance, that paper money bill S has been identified by the inpayment identification unit 147 as being paper money S of that type whose collection case is in the full state, then, by performing opening operation of the separation unit 140G*b* to the collection aperture 117*b* of the replenishment and collection case 117, the controller puts the system into a state in which it is capable of diverting that paper money bill S into the replenishment and collection case 117, and reverses the conveyance unit 137 so as to store that paper money bill S in the replenishment and collection case 117 via the conveyance path 140*b* which branches off at the separation unit 140G*b*.

On the other hand, if the paper money bill S is identified by the inpayment identification unit 147 as paper money S which cannot be paid in, then the controller stops the conveyance unit 137 at the timing when the bill S arrives at the above-mentioned position at which the identification information detection has been completed, in concrete terms, at the timing when the detection of the paper money bill S over its entire long side direction by the various sensors for identifying the paper money bill S which are included in the inpayment identification unit 147 has been completed. And when, during this stoppage of conveyance, that paper money bill S is detected by the inpayment identification unit 147 as being a paper money bill S which cannot be paid in, next, in the case of a change payment first system, the controller simply stores it in the replenishment and collection case 117, since the inpayment has already been made by hand input, although it has been decided that an identification mistake has occurred. In other words when, by performing opening operation of the separation unit 140G*b* towards the collection aperture 117*b* of the replenishment and collection case 117, the system enters a state in which it is possible to divert that paper money bill S into the collection case 117, the controller reverses the conveyance unit 137 and conveys that paper money bill S to the replenishment and collection case 117 via the conveyance path 140*b* which branches off at the separation unit 140G*b*. Furthermore, in the case of an inpayment first and confirmation system, after the conveyance unit 137 has stopped as described above, when, by performing opening operation of the separation unit 139G to the money output unit 116, the system has entered a state in which it is capable of diverting that paper money bill S to the money output unit 116, the controller reverses the conveyance unit 137 and conveys that paper money bill S to the money output unit 116 via the conveyance path 139 which branches off at the separation unit 139G. And thereby a state in which it is possible to remove the paper money bill S from the money output unit 116 to the exterior of the device is established, so that this bill S is returned to the operator. Thus, since these types of reverse conveyance are made possible, it is arranged for the conveyance unit 137 to convey only one paper money bill S at one time, and when, during such conveyance, the paper money bill S exits the conveyance unit 137, then the next paper money bill S is conveyed.

[Outpayment Processing]

At the time of outpayment processing, one of the operator side paper money outpayment aperture 172 (at the front surface side 112A of the chassis 112) and the customer side paper money rear side outpayment aperture 177 (at the rear surface side of the chassis 112) is selected according to action in advance by the operator, and it is arranged for paying out of paper money S to be performed from that outpayment aperture which has thus been selected. Although, in the following explanation, it will be assumed that it is the operator side paper money outpayment aperture 172 (at the front surface side 112A of the chassis 112) which has been selected, if it is the paper money rear side outpayment aperture 177 which has been selected, almost the same operation for paying out money is performed, except that the direction of driving of the main conveyance path 138 is reversed.

During outpayment processing, a paper money bill S comes to be conveyed from one of the recirculation cases 120 through 122 via the main conveyance path 38 towards the money output unit 116, and when, during this conveyance along the main conveyance path 138, this paper money bill S is identified by the outpayment identification unit 148, the controller temporarily stops the conveyance by the conveyance unit 137 of that paper money bill S at the timing when it arrives at the position at which its identification information detection has been completed, in concrete terms, at the timing when the detection of the paper money bill S over its entire long side direction by the various sensors for identifying the paper money bill S which are included in the outpayment identification unit 148 has been completed. When, during this conveyance stoppage, the paper money bill S is identified by the outpayment identification unit 148 as one which is being forwarded without being overlapped, next, by operating the separation unit 139G to open it so as to divert the paper money bill S to the money output unit 116, the controller establishes a state in which it is possible for that paper money bill S to be diverted to the money output unit 116, and then it restarts the conveyance of that paper money bill S by the conveyance unit 137. Due to this, that paper money bill S is fed into the money output unit 116 via the conveyance path 139 which branches off at the separation unit 139G. In this case, the outpayment identification unit 148 includes only an overlapping detection sensor, and only detects overlapping during forwarding.

On the other hand, if it has been detected by the outpayment identification unit 148 that this is paper money S which is overlapped during forwarding and cannot be paid out, then the controller stops the conveyance by the conveyance unit 137 at the timing when it arrives at the position at which its identification information detection has been completed, in concrete terms, at the timing when the detection of the paper money bills S over their entire long side direction by the various sensors for identifying the paper money bills S which are included in the outpayment identification unit 148 has been completed. When, during this conveyance stoppage, it is detected by the outpayment identification unit 148 that these paper money bills S are paper money which is overlapped during its forwarding, then, by operating the separation unit 141G towards the rejected-for-payout case 118 to open it, the controller establishes a state in which it is possible for those paper money bills S to be diverted to the rejected-for-payout case 118, and then it reverses the conveyance unit 137, so as to convey those paper money bills S to the rejected-for-payout case 118 via the conveyance path 141 which branches off at the separation unit 141G.

By appropriately repeating the conveyance of paper money bills S to the money output unit 116, when the number of bills S which is required to be paid out is conveyed to the money output unit 116, the money output unit 116 is put into a state in which it is possible to pass out those paper money bills S from the outpayment aperture 172 to the exterior of the device.

[Collection Processing]

During collection processing, a paper money bill S comes to be conveyed from one of the recirculation cases 120 through 122 via the main conveyance path 138 towards the replenishment and collection case 117, and when, during this conveyance along the main conveyance path 138, this paper money bill S is identified by the outpayment identification unit 148 as one which is not overlapped during this forwarding, the controller temporarily stops the conveyance of that paper money bill S by the conveyance unit 137 at the timing when it arrives at the position at which its above-mentioned identification information detection has been completed, in concrete terms, at the timing when the detection of the paper money bill S over its entire long side direction by the various sensors for identifying the paper money bill S which are included in the outpayment identification unit 148 has been completed. And when, during this conveyance stoppage, the paper money bill S is identified by the outpayment identification unit 148 as being one which is being forwarded without being overlapped, next, by operating the separation unit 140G*b* for diversion to the collection aperture 117*b* of the replenishment and collection case 117 so as to open it, the controller establishes a state in which it is possible for that paper money bill S to be diverted to the replenishment and collection case 117, and then it restarts the conveyance of that paper money bill S by the conveyance unit 137. Due to this, that paper money bill S is fed into the replenishment and collection case 117 via the conveyance path 140*b* which branches off at the separation unit 140G*b*. It should be understood that, according to requirements, the exchange of the replenishment and collection case 117 may be repeated, while the amount of money to be collected is being checked by the outpayment identification unit 148.

On the other hand, if it has been detected by the outpayment identification unit 148 that this is paper money S which is overlapped during forwarding, then the controller temporarily stops the conveyance by the conveyance unit 137 at the timing when these bills arrive at the above-mentioned position at which their identification information detection has been completed, in concrete terms, at the timing when the detection of the paper money bills S over their entire long side direction by the various sensors for identifying the paper money bills S which are included in the outpayment identification unit 148 has been completed. And when, during this conveyance stoppage, these paper money bills S are identified by the outpayment identification unit 148 as paper money S which is overlapped during its forwarding, then, by operating the separation unit 141G to open it to the rejected-for-payout case 118, the controller establishes a state in which it is possible for those paper money bills S to be diverted to the rejected-for-payout case 118, and then it reverses the conveyance unit 137, so as to convey those paper money-bills S to the rejected-for-payout case 118 via the conveyance path 141 which branches off at the separation unit 141G. It should be understood that, after collection processing has been completed, the paper money bills S are passed out from this rejected-for-payout case 118 by hand. Furthermore, in the case of collecting the paper money bills S in the paper money input and output device 111 while leaving a remainder, i.e. of collecting them while leaving a portion thereof for change payment the next day or the like, then, in order to approximately ascertain the number of bills in the recirculation cases 120 through 122, the above-described operation is repeated while omitting the left over amounts. Moreover if, as described above, three of the recirculation cases 120 through 122 are present, it may also be the case that, according to the type of paper money S which is set for each of the recirculation cases 120 through 122, there may be a recirculation case for which the number of bills remaining is zero.

[Replenishment Processing]

After all of the paper money bills S have been collected from all of the recirculation cases 120 through 122 (for example, the next working day), or if a shortage has occurred in the paper money in any one of the recirculation cases 120, 121, and 122 during payout processing, then replenishment of the paper money bills S in one or all of the recirculation cases 120, 121, and 122 from the replenishment and collection case 117 is performed. It should be understood that, during replenishment processing after complete collection, before starting the replenishment processing, the replenishment and collection case 117 in which paper money bills S of a plurality of types have been loaded in a mixed state is set into the interior of the device.

During this replenishment processing, paper money bills S which have been loaded into the replenishment and collection case 117 are forwarded out from the outpayment aperture 117*a* into the main conveyance path 138 via the branched off conveyance path 140*a* one bill at a time, and these paper money bills S are conveyed along the main conveyance path 138 in the direction of the inpayment identification unit 147. By doing this, a paper money bill S which has been forwarded out into the main conveyance path 138, during its conveyance, comes to be identified by the inpayment identification unit 147, but the controller temporarily stops the conveyance of that paper money bill S by the conveyance unit 137 at the timing when it arrives at the above-mentioned position at which its identification information detection has been completed, in concrete terms, at the timing when the detection of the paper money bill S over its entire long side direction by the various sensors for identifying the paper money bills S which are included in the inpayment identification unit 147 has been completed. And when, during this conveyance stoppage, the type of paper money bill S is identified by the inpayment identification unit 147, if it is considered to be necessary to replenish the paper money bills S in any one of the recirculation cases 120 through 122 which corresponds to this identified money type, then the controller operates the one, among the separation units 171G, 142G, and 143G of the recirculation cases 120, 121, and 122, which corresponds to the type of money which has thus been identified to open it; while, if it is not considered to be necessary to replenish the paper money bills S in the one of the recirculation cases 120 through 122 which corresponds to this identified money type, then it operates the separation unit 140G*b* on the side of the collection aperture 117*b* of the replenishment and recirculation case 117.

After this, the controller restarts the operation of the conveyance unit 137, and, if a paper money bill S is charged in any one of the recirculation cases 120, 121, and 122, then that paper money bill S is sent to the rear side (the rear surface side of the chassis 112) by the conveyance unit 137; while, if no paper money bill S is charged in any one of the recirculation cases 120, 121, and 122, then the conveyance unit 137 is reversed and that paper money bill S is returned and conveyed to the front side (the front surface 112A side of the chassis 112).

By doing this, when the operation of the conveyance unit 137 is restarted, under circumstances in which it is considered to be currently necessary to replenish the paper money bills S in the recirculation case 120, 121, or 122 corresponding to the type of money which has been identified, the paper money bills S come to be stored in that recirculation case 120, 121, or 122 corresponding to the type of money which has been identified; while, under circumstances in which it is not considered to be currently necessary to replenish the paper money bills S in the recirculation case 120, 121, 122, the paper money bills S come to be collected in the replenishment and recirculation case 117.

The above-described operation to charge the paper money S is repeated until the number of paper money bills S stored in the recirculation cases 120, 121, and 122 arrives at the set number of bills. When the operation is continued by doing this, even if the types of paper money bills S within the replenishment and collection case 117 are mixed together, nevertheless the set number of paper money bills S which it is the objective to replenish into the recirculation cases 120, 121, and 122 comes to be automatically replenished.

[Processing for Scrutinization of the Recirculation Cases]

When, during payout of money by the paper money input and output device 111, overlapped forwarding of paper money bills S is detected by the outpayment identification unit 147, then, as previously described, these paper money bills S are collected in the rejection case 118 just as they are, without ascertaining the number of bills of paper money S which are being forwarded as overlapped. Due to this, when payout of money by the paper money input and output device 111 is repeatedly performed, it becomes impossible to ascertain the number of paper money bills S stored in the interiors of the recirculation cases 120, 121, and 122 accurately. With this paper money input and output device 111, as a countermeasure, it is arranged for it to be possible, by utilizing the replenishment and collection case 117, to scrutinize the number of bills of stored paper money S in each of the recirculation cases 120, 121, and 122.

In the scrutinization processing of these recirculation cases 120, 121, and 122, the replenishment and collection case 117 is removed from the chassis 112 and the stored paper money in its interior is emptied, and then the empty replenishment and collection case 117 is set back into the chassis 112.

Next, from this state, all of the stored paper money S from any one of the recirculation cases 120, 121, and 122 is collected in the replenishment and collection case 117, and thereafter these paper money bills S are returned from the replenishment and collection case 117 to their original recirculation case one bill at a time via the inpayment identification unit 147, and the accurate number of paper money bills S is counted at this time by the inpayment identification unit 147. Subsequently, the same type of processing is performed in order for the remaining ones of the recirculation cases 120, 121, and 122 as well, so that the number of bills of stored paper money S in all of the recirculation cases 120, 121, and 122 are accurately counted.

It should be understood that the operation of collecting the paper money bills S of the recirculation cases 120, 121, and 122 in the replenishment and collection case 171, and the operation of returning the paper money bills S which have been collected in the original recirculation cases 120, 121, and 122, are the same as in the previously described collection processing and replenishment processing.

Since, according to the paper money input and output device 111 of this embodiment as described above, the money input unit 115 to which paper-money bills S are paid in from the exterior of the device, the money output unit 116 and the rear side money output unit 185 which release paper money bills S from the interior of the device so that it becomes possible for them to be passed out to the exterior of the device, the plurality of recirculation cases 120 through 122 which, along with storing paper money bills S, output stored paper money bills S to the money output unit 116 or the rear side money output unit 185, the replenishment and collection case 117 which can store paper money bills S from the money input unit 115 or the plurality of recirculation cases 120 through 122, and can also replenish the paper money in the recirculation cases 120 through 122, and the rejected-for-payout case 118 which stores paper money bills S, among the paper money bills S which have been paid out from the recirculation cases 120 through 122, which have been rejected for outpayment, are provided in a stacked state in the thickness direction of the paper money bills S which they receive, so that the thickness direction of the paper money S is in the same direction, and the conveyance unit 337 is arranged so as to connect these together on one side only of a direction which is orthogonal with respect to the direction along which they are provided in a stacked state, accordingly it is possible to anticipate that the device as a whole may be made more compact, because it does not all extend along the same direction. Moreover, since the conveyance unit 137 is disposed on the same side of all of the money input unit 115, the money output unit 116, the replenishment and collection case 117, the rejected-for-payout case 118, the plurality of recirculation cases 120 through 122, and the rear side money output unit 185, accordingly the directions for separating the bills to the various sections do not become complicated, and, while it is possible to suppress the occurrence of jamming during the conveyance of the paper money S, even if by any unlikely chance a jam should occur, it is possible to eliminate this jam in a simple and easy manner, since access to the conveyance unit 137 is simple. In this case, such processing comes to be performed by opening up the side of the chassis 112 on the side of the conveyance unit 137.

Furthermore since, along with the money input unit 115, the money output unit 116, and the replenishment and collection case 117 constituting, taken together, the first structural group 125, and the rejected-for-payout case 118 the plurality of recirculation cases 120 through 122, and the rear side money output unit 185 constituting, taken together, the second structural group 126, the inpayment identification unit 147 which identifies the paper money S which has been paid in is provided in the intermediate conveyance path 145 between the first structural group 125 and the second structural group 126, on the side of the first structural group 125, while the outpayment identification unit 148 which identifies the paper money which is to be paid out is provided at the side of the second structural group 126 in that intermediate conveyance path 145, accordingly, even though the intermediate conveyance path 145 may be short, along with it being possible to ensure an appropriate distance between the inpayment identification unit 147 and the recirculation case 120, which needs to be at least the length of one bill of paper money S, it is also possible to ensure an appropriate distance between the outpayment identification unit 148 and the money output unit 116, which likewise needs to be at least the length of one bill of paper money S. Accordingly, it is possible to shorten the length of the money input unit 115, the money output unit 116, the replenishment and collection case 117, the rejected-for-payout case 118, the plurality of recirculation cases 120 through 122, and the rear side money output unit 185 in their stacked direction by yet a further factor.

Furthermore if, for example, a paper money bill S which has been paid into the money input unit 115 and which is being conveyed by the conveyance unit 137 is identified by the inpayment identification unit 147 as being a paper money bill S which can be paid in, then it comes to be stored in the corresponding one of the recirculation cases 120 through 122;

while, if it is identified by the inpayment identification unit 147 as being a paper money bill S which cannot be paid in and must be rejected, then, by reversing the conveyance unit 137, it can be conveyed to the money output unit 116 or to the replenishment and collection case 117. Furthermore, when the paper money outpayment aperture 172 has been selected on the operator side, if for example a paper money bill S which has been stored in one of the recirculation cases 120 through 122 and which is being conveyed by the conveyance unit 137 is identified by the outpayment identification unit 148 as being a paper money bill S which can be paid out, then it comes to be conveyed to the money output unit 116; while, if it is identified by the outpayment identification unit 148 as being a paper money bill S which cannot be paid out and must be rejected for payout, then, by reversing the conveyance unit 137, it can be conveyed to the rejected-for-payout case 118 Due to this, when the paper money bill S is identified as one which can be paid in or as one which can be paid out, the frequency of which occurrence is high, then, after the conveyance unit 137 has been stopped it is not reversed; however, when and only when the paper money bill S is identified as one which cannot be paid in and must be rejected for inpayment, or as one which cannot be paid out and must be rejected for outpayment, the frequency of which occurrence is low, then the conveyance unit 137 is reversed (switched back) after it has been stopped, and accordingly it is possible to suppress an increase in length of the processing time to the greatest possible degree.

Furthermore due to the fact that the conveyance of a paper money bill S which is being conveyed from the money input unit 115 by the conveyance unit 137 is temporarily stopped by the controller based upon the timing by which that paper money bill S by the conveyance unit 137 is detected by the inpayment identification unit 147, and that the conveyance of that paper money bill S by the conveyance unit 137 is restarted, when a situation is established in which it is possible for that paper money bill S to be received by the corresponding one of the recirculation cases 120 through 122 for that type of money, accordingly it is not necessary to convey the paper money bill S during the time period from when its detection has been completed until its identification has been completed, so that thereby it is possible further to shorten the distance between the inpayment identification unit 147 and the recirculation cases 120 through 122. Accordingly, it is possible to shorten the length of the money input unit 115, the money output unit 116, the replenishment and collection case 117, the rejected-for-payout case 118, the plurality of recirculation cases 120 through 122, and the rear side money output unit 185 in their stacked direction by yet a further factor.

In addition, due to the fact that the conveyance of a paper money bill S which is being conveyed from one of the recirculation cases 120 through 122 by the conveyance unit 137 is temporarily stopped by the controller based upon the timing by which that paper money bill S by the conveyance unit 37 is detected by the outpayment identification unit 148, and that the conveyance of that paper money bill S by the conveyance unit 137 is restarted, when a situation is established in which it is possible for that paper money bill S to be received by the money output unit 116, accordingly it is not necessary to convey the paper money bill S during the time period from when its detection has been completed until its identification has been completed, so that thereby it is possible further to shorten the distance between the outpayment identification unit 148 and the money output unit 116. Accordingly, it is possible to shorten the length of the money input unit 115, the money output unit 116, the replenishment and collection case 117, the rejected-for-payout case 18, the plurality of recirculation cases 120 through 122, and the rear side money output unit 185 in their stacked direction by yet a further factor.

Furthermore since, in the first structural group 125, the money input unit 115, the money output unit 116, and the collection case 117 are stacked in that order, and moreover the replenishment and collection case 117 is provided as the one closest to the second structural group 126, accordingly, while ensuring the convenience of use of the money input unit 115 and the money output unit 116, it is also possible to guarantee the distance between the outpayment identification unit 148 and the money output unit 116.

Additionally since, in the second structural group 126, the rejected-for-payout case 118 is provided as being the one closest towards the first structural group 125, accordingly it is possible to guarantee the distance between the inpayment identification unit 147 and the recirculation case 120.

It should be understood that it would also be possible, during outpayment, not to operate the separation unit 139G to open it to convey a paper money bill S to the outpayment aperture 133, after the paper money bill S has been detected by the outpayment identification unit 148, and the conveyance by the conveyance unit 137 has been temporarily stopped, and it has been checked that overlapped forwarding is not taking place, but rather, during outpayment, to operate the separation unit 139G to open it from the beginning. However if, even during outpayment, the separation unit 139G is put into the closed state from the beginning, by opening the separation unit 139G and conveying the paper money S to the money output unit 116 after the paper money bill S has been stopped, it becomes possible to decide whether or not the paper money bill S being conveyed when the error occurred is paper money S under machine management, or is paper money S taken as paid out, according to whether the separation unit 139G is in the open or the closed state. In other words, if the separation unit 139G is closed, the paper money bill S which is positioned directly before it is taken as being paper money S under machine management, whereas, if the separation unit 139G is open, even if there is a paper money bill S which is positioned directly before it, it is supposed that this is a paper money bill S taken as paid out.

Furthermore since it is arranged, in the case of the paper money input and output device 111 of this embodiment, to utilize the replenishment and collection case 117 which has both the inpayment aperture 117*a* and the collection aperture 117*b*, accordingly there is the beneficial aspect that not only is it possible, when replenishing the paper money bills S into the recirculation cases 120 through 122, to perform the collection of the paper money bills S from the money input unit 117 and/or the recirculation cases 120 through 122 with a single cassette component, but it is also possible to accurately scrutinize the number of bills of paper money S held in the recirculation cases 120 through 122, by the cooperative operation as previously described of the replenishment and collection case 117 and the inpayment identification unit 147.

Furthermore since, in this embodiment as the money output unit which releases the paper money bills S from the interior of the device, apart from the money output unit 116 (the front side money output unit) on the operator side, there is also provided, in the same manner, the rear side money output unit on the customer side, accordingly it is possible to enhance the convenience for taking out money, along with making the device more compact overall, and suppressing the occurrence of jamming.

It should be understood that the embodiments of this invention are not limited to the above-described embodiments; various changes in the design can be made, provided that the gist of the present invention is not departed from. For example although, in the above-described embodiments, the replenishment case for replenishing the paper money bills S in the recirculation cases 120 through 122, and the collection case in which it was possible to store paper money bills S from the money input unit 115 and the recirculation cases 120 through 122, were provided as the common replenishment and collection case 117, it would also be possible to provide the replenishment case and the collection case separately. Furthermore, it would also be possible to make a common money input and output aperture serve both as the paper money inpayment aperture 171 and as the paper money outpayment aperture 172 of the above-described embodiments.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A paper money input and output device, comprising:

a front surface, a rear portion, and an upper surface extending between the front surface and the rear portion;

a money input unit having an inpayment aperture exposed to an exterior of the device and thereby configured to directly receive paper money paid in from a source external of the device, said money input unit being positioned relatively near said front surface;

a money output unit having an outpayment aperture exposed to an exterior of the device and thereby configured to directly eject to an area external of the device paper money received from an interior portion of the device;

a plurality of recirculation cases which receive paper money from said money input unit, said plurality of recirculation cases supplying the received paper money to said money output unit, said plurality of recirculation cases being positioned relatively near said rear portion;

a collection case which receives paper money from said money input unit, said plurality of recirculation cases supplying paper money to said collection case, said collection case receiving the paper money from said plurality of recirculation cases; and a rejected-for-payout case which stores money, among the paper money which has been paid out from said recirculation cases, which has been rejected for outpayment, said money input unit, said money output unit, said collection case, said rejected-for-payout case, and said plurality of recirculation cases being aligned with each other along a stacked direction that extends from said front surface toward the rear portion which is the same direction as the thickness direction of the paper money which they receive, and said money input unit, said money output unit, said collection case, said rejected-for-payout case, and said plurality of recirculation cases being provided in a stacked state in said stacked direction;

a conveyance unit which is configured to connect said money input unit, said money output unit, said collection case, said rejected-for-payout case, and said plurality of recirculation cases, said conveyance unit being disposed, in a plan view, on a same lateral side of each of the money input unit, the money output unit, the collection case, the rejected-for-payout case, and the plurality of recirculation cases, said conveyance unit having a main conveyance path configured to convey said paper money between the money input unit, the money output unit, the collection case, the rejected-for-payout case, and the plurality of recirculation cases, said main conveyance path extending substantially horizontally along the thickness direction of the paper money from a position relatively near the front surface toward the rear portion;

an inpayment identification unit which identifies paper money, said money input unit, said money output unit, and said collection case together constituting a first structural group and said rejected-for-payout case and said plurality of recirculation cases constituting a second structural group, said inpayment identification unit being provided on the side of said first structural group in an intermediate conveyance path of said conveyance unit between said first structural group and said second structural group;

a control unit which controls said conveyance unit; and an outpayment identification unit which identifies paper money for outpayment and is provided on a side of said second structural group in said intermediate conveyance path, said outpayment identification unit being arranged so that said outpayment identification unit is spatially positioned between said money output unit and said rejected-for-payment case with respect to said stacked direction and said rejected-for-payment case is spatially positioned between said outpayment identification unit and said recirculation cases with respect to the stacked direction, said conveyance path of said conveyance unit connecting between said money output unit and said rejected-for-payment case, before paper money which is being conveyed by said conveyance unit via said main conveyance path from said recirculation case is diverted to said money output unit or said rejected-for-payment case, based upon the timing at which said paper money is detected by said outpayment identification unit, said control unit controlling the conveyance of said paper money by said conveyance unit so as to temporarily stop said paper money in said main conveyance path, and said control unit restarting conveyance of said paper money identified by said outpayment identification unit as being paper money which can be paid out and diverts said paper money to said money output unit, and said control unit restarting conveyance of said paper money identified by said outpayment identification unit as being paper money which cannot be paid out by reversing said conveyance unit, and stores said paper money to said rejected-for-payout case.

2. A paper money input and output device as claimed in claim 1, wherein, in said first structural group, said money input unit, said money output unit, and said collection case are stacked in that order, and said collection case is provided on the side closest towards said second structural group.

3. A paper money input and output device as claimed in claim 1, wherein, in said second structural group, said rejected-for-payout case is provided on the side closest towards said first structural group.

4. A paper money input and output device as claimed in claim 1, further comprising a replenishment case for replenishing the paper money in said plurality of recirculation cases, said replenishment case being provided as stacked with said money input unit, said money output unit, said collection case, said rejected-for-payout case, and said plurality of recirculation cases and connected to said money input unit, said money output unit, said collection case, said rejected-for-payout case, and said plurality of recirculation cases by said conveyance unit.

5. A paper money input and output device as claimed in claim 4, further comprising a replenishment and collection case including said collection case and said replenishment case.

6. A paper money input and output device as claimed in claim 4, wherein said money output unit comprises a front side money output unit on the side of an operator, and a rear side money output unit on the side of a customer.

7. A paper money input and output device as claimed in claim 1, wherein based upon the timing at which paper money which is being conveyed by said conveyance unit via said main conveyance path from said money input unit is detected by said inpayment identification unit, said control unit controls the conveyance of said paper money by said conveyance unit so as to temporarily stop said paper money in said main conveyance path, and said control unit restarts conveyance of said paper money identified by said identification unit as being paper money which can be paid in and stores said paper money to one of said recirculation cases, and said control unit restarts conveyance of said paper money identified by said identification unit as being paper money which cannot be paid in by reversing said conveyance unit and stores said paper money to one of said rejected-for-payout case and said collection case.

8. A paper money input and output device as claimed in claim 1, wherein said money input unit includes:

a reception stand which receives paper money, and includes a wall plate portion, a shutter which is provided at an upper end portion of said wall plate portion and opens and closes the inpayment aperture, and a bottom plate portion which is provided at a lower end portion of said wall plate portion;

a shift roller which is provided on said wall plate portion, a rotational axis thereof being oriented along a widthwise direction of a chassis;

a forwarding roller which is provided on said wall plate portion, a central axial line thereof being oriented along a vertical direction of said chassis; and a guide roller which is provided on the said wall portion and at a position higher than said bottom plate portion, a rotational axis of the guide roller being oriented in a depth direction of said chassis.

9. A paper money input and output device as claimed in claim 8, wherein said money input unit further includes:

a shaking mechanism which vibrates said reception stand vertically to cause any foreign bodies to fall off of paper money; and a foreign body reception tray which is provided under said guide roller and which receives any foreign bodies which fall off of said paper money, and said shaking mechanism includes a plurality of eccentric rollers which contact against said reception stand from underneath.

10. A paper money input and output device as claimed in claim 1, further comprising:

a chassis which stores the money input unit, the money output unit, the collection case, the recirculation cases, the rejected-for-payout case, and the conveyance unit, wherein the chassis includes a lid portion covering the money input unit and the money output unit, and the money input unit, the money output unit, and the collection case are configured to be removed from the chassis in a state of the lid portion being open.

11. A paper money input and output device, comprising:

a money input unit having an inpayment aperture configured to receive paper money supplied from a source external of the device, the inpayment aperture being arranged to receive a long edge of the paper money along a width of the inpayment aperture, the money input unit including a reception stand rotatable about an axis extending in a width direction of the money input unit between a rotated position and a rest position;

a money output unit having an outpayment aperture to eject to an area external of the device paper money received from an interior portion of the device;

a plurality of recirculation cases which receive paper money from the money input unit, the recirculation cases supplying paper money to the money output unit;

a collection case which receives paper money from the money input unit, the recirculation cases supplying paper money to the collection case, the collection case receiving the paper money from the recirculation cases;

a rejected-for-payout case which receives paper money rejected for outpayment from the recirculation cases; and a conveyance unit which connects the money input unit, the money output unit, the collection case, the rejected-for-payout case, and the recirculation cases, the conveyance unit being disposed, in a plan view, on a same lateral side of the money input unit, the money output unit, the collection case, the rejected-for-payout case, and the recirculation cases, the money input unit, the money output unit, the collection case, the rejected-for-payout case, and the recirculation cases being aligned with one another, wherein the reception stand includes shift rollers arranged to pull in the paper money from the source external of the device when the reception stand is in the rotated position, the shift rollers being rotatable about an axis extending in the width direction of the money input unit, and wherein the reception stand is configured to forward the paper money is the width direction of the money input unit to the conveyance unit after the reception stand has returned to the rest position.

12. A paper money input and output device as claimed in claim 11, further comprising:

a chassis which stores the money input unit, the money output unit, the collection case, the recirculation cases, the rejected-for-payout case, and the conveyance unit, wherein the chassis includes a lid portion covering the money input unit and the money output unit, and the money input unit, the money output unit, and the collection case are configured to be removed from the chassis in a state of the lid portion being open.

13. A paper money input and output device as claimed in claim 11, wherein the reception stand includes forwarding rollers configured to forward the paper money to the conveyance unit, the forwarding rollers being rotatable about an axis extending in a vertical direction of the money input unit.

* * * * *